US011247874B2

(12) United States Patent
Bakalyar

(10) Patent No.: US 11,247,874 B2
(45) **Date of Patent: *Feb. 15, 2022**

(54) LIFTING SYSTEM

(71) Applicant: Shane Bakalyar, Murfreesboro, TN (US)

(72) Inventor: Shane Bakalyar, Murfreesboro, TN (US)

( * ) Notice: Subject to any disclaimer, the term of this patent is extended or adjusted under 35 U.S.C. 154(b) by 253 days.

This patent is subject to a terminal disclaimer.

(21) Appl. No.: 16/374,877

(22) Filed: Apr. 4, 2019

(65) Prior Publication Data

US 2019/0225461 A1 Jul. 25, 2019

Related U.S. Application Data

(63) Continuation of application No. 15/843,243, filed on Dec. 15, 2017, now Pat. No. 10,252,891, which is a continuation of application No. 15/233,217, filed on Aug. 10, 2016, now abandoned, which is a continuation of application No. 14/547,995, filed on Nov. 19, 2014, now Pat. No. 9,434,580.

(51) Int. Cl.
*B66C 1/28* (2006.01)
*B66C 1/12* (2006.01)

(52) U.S. Cl.
CPC . *B66C 1/28* (2013.01); *B66C 1/12* (2013.01)

(58) Field of Classification Search
CPC ..... B66C 1/28; B66C 1/12; B66C 1/00
USPC ..... 294/81.56, 81.5, 81.1, 81.21
See application file for complete search history.

(56) References Cited

U.S. PATENT DOCUMENTS 819,576 A * 5/1906 McCabe
1,781,943 A * 11/1930 Bartholomew ..... B66C 1/28 294/67.31
1,834,902 A * 12/1931 Payzant ..... B66C 1/16 294/67.4

(Continued)

FOREIGN PATENT DOCUMENTS

BR 0806586 A2 5/2014
CA 2675330 A1 7/2008

(Continued)

OTHER PUBLICATIONS

International Search Report for PCT/US2015/061434, three pages.

(Continued)

*Primary Examiner* — Paul T Chin
(74) *Attorney, Agent, or Firm* — Waller Lansden Dortch & Davis, LLP; Blake M. Bernard

(57) ABSTRACT

An apparatus including a base, a guide arm pivotable relative to the base, the guide arm movable between a raised position and a lowered position. A tension linkage has a distal end extending away from the base, the tension linkage supported by the guide arm when the arm is in the raised position. A tension linkage guide is disposed on the guide arm, the tension linkage guide movable along the tension linkage as the guide arm moves between raised and lowered positions. A hook is connected to the distal end of the tension linkage. When the hook is engaged with an object, the tension linkage forms a first tension angle and a second tension angle when the guide arm is in the raised position and the lowered position respectively, the second tension angle being less than the first tension angle.

20 Claims, 19 Drawing Sheets

(56) References Cited

U.S. PATENT DOCUMENTS

| | | | | |
|---|---|---|---|---|
| 2,331,566 | A | 10/1943 | Pautz | |
| 2,780,487 | A * | 2/1957 | Bredensteiner | A01D 87/126 294/81.56 |
| 3,010,751 | A | 11/1961 | Day | |
| 3,039,746 | A | 6/1962 | Meyers | |
| 3,257,142 | A | 6/1966 | Barry | |
| 3,356,237 | A | 12/1967 | Walton | |
| 3,572,801 | A * | 3/1971 | Howard | B66C 1/28 294/67.32 |
| 3,945,674 | A * | 3/1976 | Ide | B66C 1/10 294/67.1 |
| 3,972,553 | A | 8/1976 | Johnston | |
| 4,128,267 | A | 12/1978 | Niblett | |
| 4,258,949 | A | 3/1981 | Keagbine | |
| 4,471,989 | A | 9/1984 | Taylor | |
| 4,648,645 | A | 3/1987 | Lundgren | |
| 4,826,228 | A * | 5/1989 | Dinitz | B66C 1/12 294/67.1 |
| 5,037,151 | A | 8/1991 | Kameyama | |
| 5,207,795 | A | 5/1993 | Sato | |
| 5,297,832 | A * | 3/1994 | Dewey | B66C 1/12 294/67.4 |
| 5,342,104 | A | 8/1994 | Sato | |
| 5,480,201 | A | 1/1996 | Mercer | |
| 5,895,083 | A | 4/1999 | Bidwell | |
| 5,961,170 | A | 10/1999 | Baumann et al. | |
| 6,354,782 | B1 | 3/2002 | Barry | |
| 7,159,912 | B2 | 1/2007 | Gerhausser | |
| 7,290,815 | B1 * | 11/2007 | Whittington | B66C 1/14 294/67.4 |
| 7,905,528 | B2 | 3/2011 | Marcel | |
| 8,016,333 | B2 | 9/2011 | Brunner | |
| 8,358,371 | B1 * | 1/2013 | Dickey | B66C 13/46 348/372 |
| 2001/0000464 | A1 | 4/2001 | Beale | |
| 2003/0025347 | A1 | 2/2003 | Shawaykowski | |
| 2006/0181096 | A1 | 8/2006 | Gerhausser | |
| 2009/0102213 | A1 | 4/2009 | Ritchie | |
| 2011/0260479 | A1 | 10/2011 | Fillol Vidal | |
| 2016/0152449 | A1 * | 6/2016 | Bernat | B66C 1/16 294/81.1 |

FOREIGN PATENT DOCUMENTS

| | | | |
|---|---|---|---|
| CN | 101652309 | A | 2/2010 |
| EP | 2107032 | A1 | 7/2009 |
| FR | 2608138 | A1 | 6/1988 |
| JP | 07206367 | A | 8/1995 |
| JP | 092774 | | 1/1997 |
| JP | 2002225977 | A | 8/2002 |
| MX | 2009007382 | A | 10/2009 |
| WO | 9703911 | A1 | 2/1997 |
| WO | 2008084130 | A2 | 7/2008 |

OTHER PUBLICATIONS

International Search Report for PCT/ES2008/000009, three pages.
Lift Incorporated, Custom Installations; Jul. 14, 2014, 4 pages; http://www.liftinc.com/images/photos/disk3.jpg.

* cited by examiner

LIFTING SYSTEM

CROSS-REFERENCES TO RELATED APPLICATIONS

This application is a continuation of U.S. patent application Ser. No. 15/843,243 filed Dec. 15, 2017 entitled Cargo Vessel Lid Lifting System, which is a continuation of U.S. patent application Ser. No. 15/233,217 filed Aug. 10, 2016 for CARGO VESSEL LID LIFTING SYSTEM; which is a continuation of U.S. patent application Ser. No. 14/547,995 filed Nov. 19, 2014 entitled CARGO VESSEL LID LIFTING SYSTEM (which is now U.S. Pat. No. 9,434,580), each of which is herein incorporated by reference in its entirety.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present disclosure relates generally to lifting systems and particularly to lid removal systems for cargo vessels. Cargo vessels are typically covered by one or more large heavy lids during transport to help protect the contents contained within the cargo vessel from the elements or from potential contaminants. Once the cargo vessel arrives at its final location, the lids must be removed from the cargo vessel to access and remove the contents or loading additional contents.

More particularly, this disclosure pertains to lid removal devices for cargo vessel lids which utilize an overhead crane or rigging system. One conventional solution for removing cargo vessel lids includes attaching a plurality of straps to an overhead crane or boom. The opposing ends of the straps can include hooks, each hook being attached to a corresponding location on the lid. The crane can then be used to pull the straps upward to lift and disengage the lid from the cargo vessel.

One problem with such a solution is that typically an operator is required to climb on top of the lid in order to retrieve the straps, which can be unsafe. Another problem with such a solution is that the hooks have to be attached to the lid manually, which can potentially be unsafe as well as time consuming. In one particular application of a lid removal system for a barge lid, the operator must walk around the edge of the barge in order to manually connect each hook to the lid, in addition to climbing on top of the barge lid to retrieve the straps. The barge often includes numerous obstructive objects which can be tripping hazards for operators walking around the barge to attach the hooks to the lids. If an operator loses his balance while either atop the barge lid or while walking along the edge of the barge, the operator could suffer serious injury, and could potentially fall off of the barge, which could cause serious injury or death.

Others have attempted to overcome the problems of conventional rigging by providing a strap spreader with multiple straps attached to the spreader. These solutions can potentially remove the need to climb on top of the cargo vessel lids, as the spreader can hold the straps radially outward from the crane or the rig. However, an operator must still attach the hooks manually to the lid. Additionally, the spreaders can be place under significant stress from tension and moment forces while the lids are being lifted, as the forces are being applied at the outer ends of the spreader. These stresses can cause the spreaders to wear and fatigue over time. Failure of the spreaders can cause the lids to fall during the removal operation, which can potentially cause serious injury to those nearby, as well as damage to the cargo vessel or other property.

What is needed, then, are improvements in devices for removing cargo vessel lids.

BRIEF SUMMARY OF THE INVENTION

One aspect of the present disclosure pertains to an apparatus for moving a cargo vessel lid. The apparatus includes a base and a guide arm pivotable relative to the base. The guide arm can be movable between a raised position and a lowered position. A tension linkage can have a distal end extending away from the base. The tension linkage can be supported by the guide arm when the guide arm is in the raised position. A tension linkage guide can be disposed on the guide arm. The tension linkage guide can be movable along the tension linkage as the guide arm moves between the raised position and the lowered position. A lid hook can be connected to the distal end of the tension linkage. The tension linkage can form a first tension angle with respect to a horizontal reference axis passing through the lid hook when the lid hook is engaged with the cargo vessel lid and the guide arm is in the raised position. The tension linkage can form a second tension angle with respect to the horizontal reference axis when the lid hook is engaged with the cargo vessel lid and the guide arm is in the lowered position. The second tension angle can be less than the first tension angle.

Another aspect of the present disclosure is an apparatus for removing a cargo lid vessel. The apparatus includes a base and a guide arm pivotable relative to the base. The guide arm can be movable between a raised position and a lowered position. The apparatus can include a tension linkage having a distal end extending away from the base. The tension linkage can be supported by the guide arm in the raised position. A lid hook can be connected to the distal end of the tension linkage, wherein the guide arm does not support the tension linkage when the lid hook is engaged with the cargo vessel lid and the guide arm is in the lowered position.

Another aspect of the present disclosure is a method of removing a lid from a cargo vessel, the method including the steps of providing a spreader device including a base and a guide arm pivotable relative to the base. The guide arm can be movable between a raised position and a lowered position. A tension linkage having a distal end extending away from the base can be supported by the guide arm when the guide arm is in the raised position. A tension linkage guide can be disposed on the guide arm, the tension linkage guide movable along the tension linkage. A lid hook can be connected to the distal end of the tension linkage. The method can further include lowering the spreader device with the guide arm in the raised position and engaging the lid hook with the cargo vessel lid, the tension linkage forming a first tension angle with respect to a horizontal reference axis passing through the lid hook. The method can further include moving the guide arm from the raised position to the lowered position, and raising the spreader device, the tension linkage forming a second tension angle with respect to the horizontal axis when the guide arm is in the lowered position, the second tension angle being less than the first tension angle.

Numerous other objects, advantages and features of the present invention will be readily apparent to those of skill in the art upon a review of the following drawings and description of a preferred embodiment.

DETAILED DESCRIPTION

Figure 1:
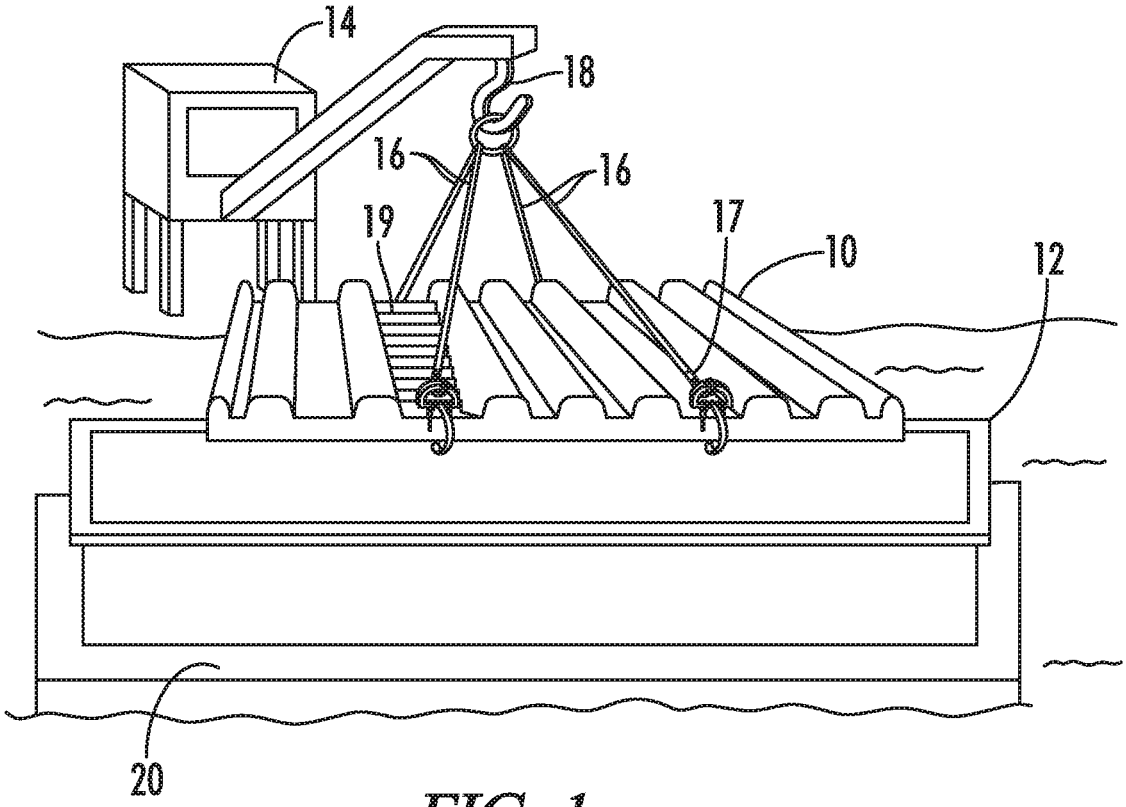
FIG. 1 (PRIOR ART)
FIG. 1 is a perspective view of a conventional cargo vessel lid removal apparatus.

While the making and using of various embodiments of the present invention are discussed in detail below, it should be appreciated that the present invention provides many applicable inventive concepts that is embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

As described herein, an upright position is considered to be the position of apparatus components while in proper operation or in a natural resting position as described herein. Vertical, horizontal, above, below, side, top, bottom and other orientation terms are described with respect to this upright position during operation unless otherwise specified. The term "when" is used to specify orientation for relative positions of components, not as a temporal limitation of the claims or apparatus described and claimed herein unless otherwise specified. The term "lateral" denotes a side to side direction when facing the "front" of an object.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the apparatuses or methods disclosed and claimed herein may be made and/or executed without undue experimentation in light of the present disclosure. While the apparatuses and methods of this invention have been described in terms of the embodiments included herein, it will be apparent to those of ordinary skill in the art that variations may be applied to the apparatuses and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

A perspective view of a conventional solution for lifting a cargo vessel lid 10 off of cargo vessel 12 is shown in FIG. 1. One conventional cargo vessel 12 shown in FIG. 1 can be a container on a barge used to transport various items by boat. Typically when the barge is docked near land, a crane 14 or rigging unit can be used on shore to remove lid 10 from cargo vessel 12. A plurality of straps 16 with hooks 17 can be used to connect a crane hook 18 located on crane 14 to multiple points on lid 10. During the removal operation, operators often must climb on top of lid 10 in order to retrieve straps 16. Some conventional lids 10 can include one or more sets of stairs 19 built into lid 10 in order to aid an operator in climbing on top of lid 10. However, climbing on top of lid 10 is still unsafe and can potentially cause serious injury if an operator were to fall while on top of lid 10.

Additionally, in order to connect hooks 17 to different points on lid 10, an operator must walk along an edge 20 of the barge around cargo vessel 12. This process can take a substantial amount of time and slow down the removal process. Additionally, often time barges have equipment or other objects located along edge 20 which could potentially be a tripping hazard. The entire removal process presents several instances where the operator is placed at risk of falling on the barge, or potentially falling off the barge into the water. In either case, the operator is exposed to risk of serious injury or even death. This method also places the operator in the area where crane 14 is being operated, which can again be unsafe.

Figure 2:
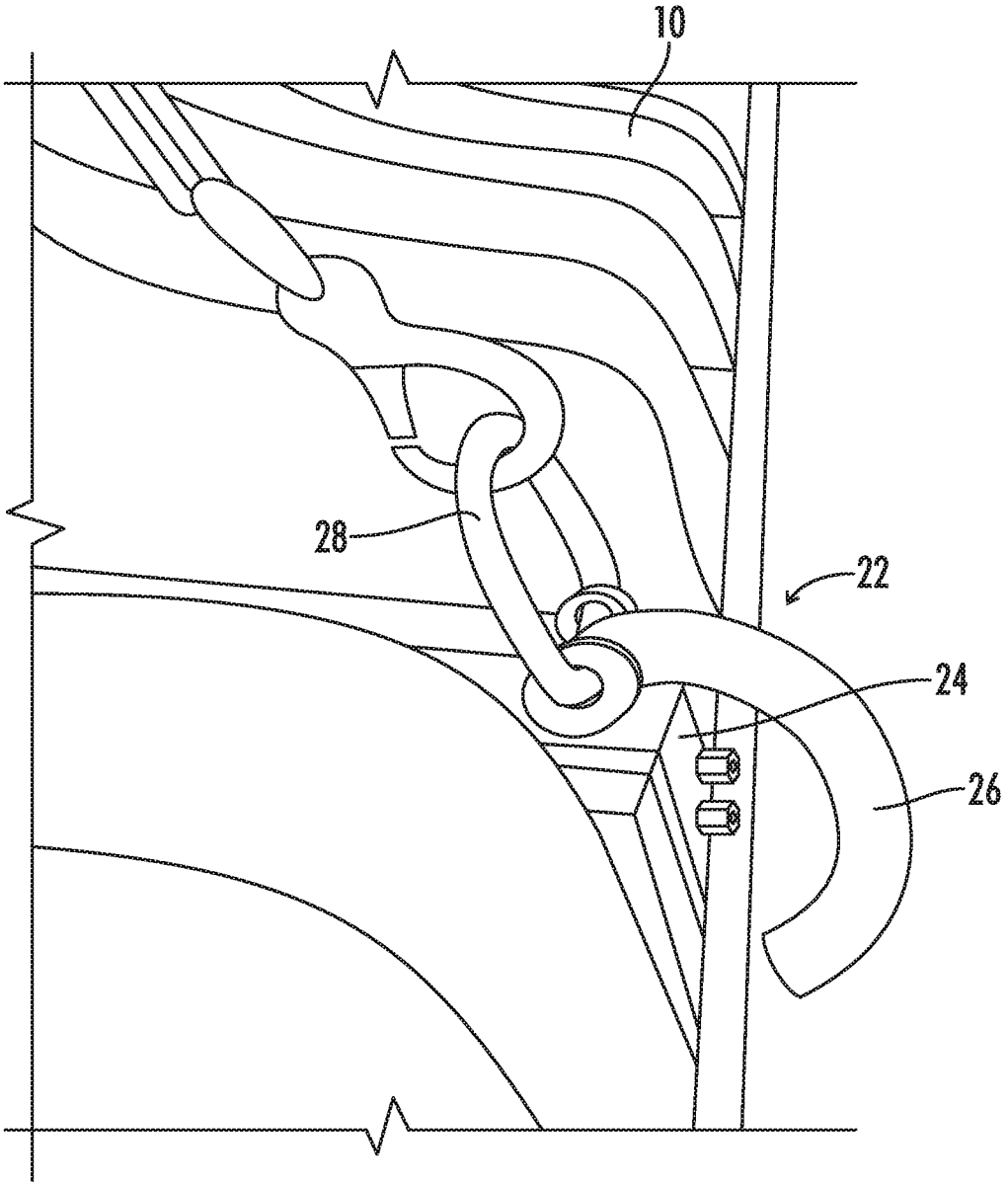
FIG. 2 (PRIOR ART)
FIG. 2 is a detailed perspective view of an embodiment of a conventional lid latch member.

As shown in FIG. 2, many conventional barge lids include one or more latch members 22. Latch member 22 can be pivotally disposed on lid 10 and can be used to effectively latch and unlatch lid 10 to and from the cargo vessel. Latch member 22 in FIG. 2 is pivotally disposed on a bracket 24 attached to lid 10. Latch member 22 can include a latch hook portion 26 and a latch lift eyelet 28. As latch member 22 rotates with respect to lid 10, latch hook portion 26 can rotate to engage or disengage the cargo vessel.

Figure 3A:
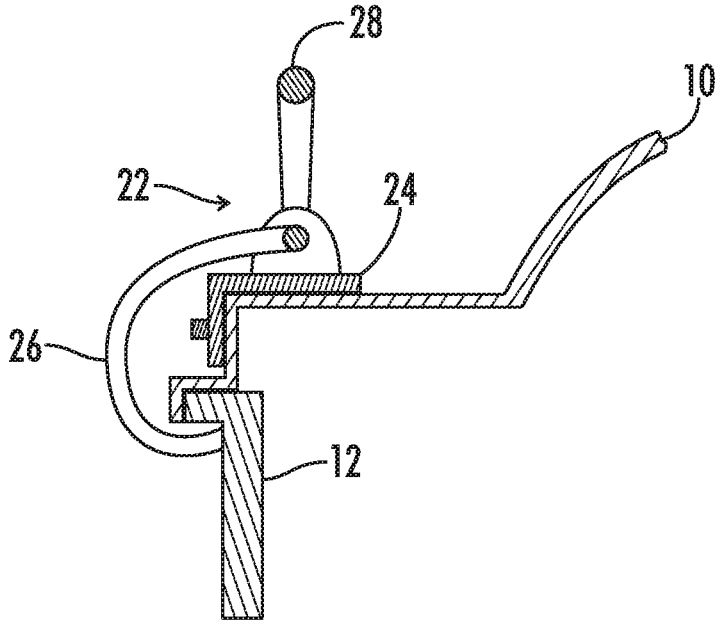
FIG. 3A (PRIOR ART)
FIG. 3A is a cross-sectional view of a conventional cargo vessel and a cargo vessel lid with a latch member in the latched position.
Figure 3B:
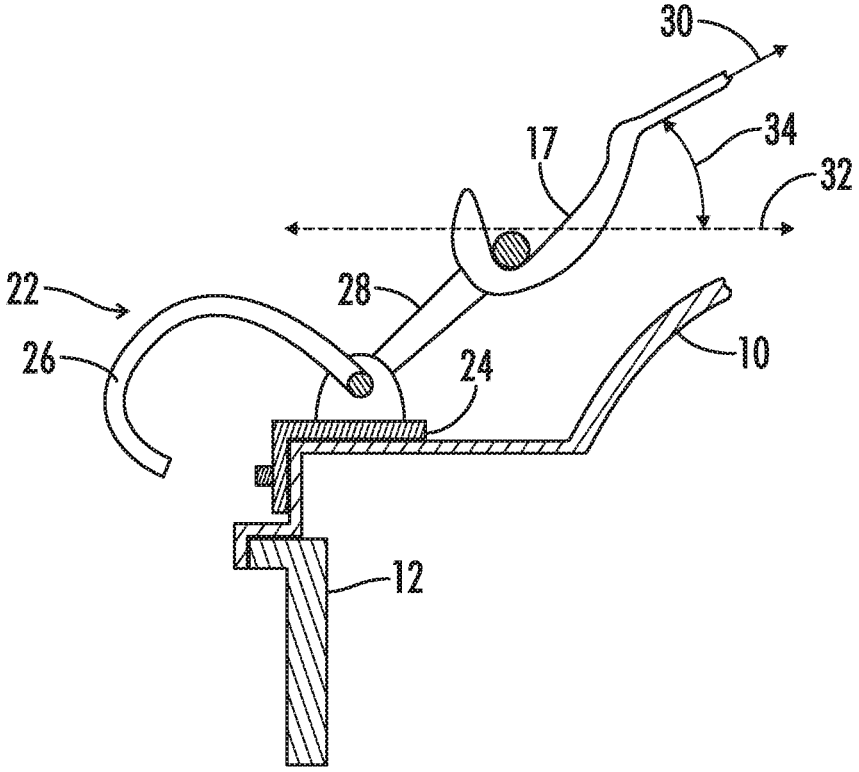
FIG. 3B (PRIOR ART)
FIG. 3B is a cross-sectional view of a conventional cargo vessel and a cargo vessel lid with a latch member in the unlatched position.

As can be seen from FIG. 3A, latch member 22 can be in a normally latched position, with latch hook portion 26 engaging cargo vessel 12 such that lid 10 remains latched to cargo vessel 12. If a direct upward force is applied to latch lift eyelet 28, then latch member 22 will remain engaged with cargo vessel 12, and lid 10 will not be removed. As such, an angled force 30 must be applied to latch lift eyelet 28 to disengage latch 22 and lid 10 from cargo vessel 12, as shown in FIG. 3B. Angled force 30 can be applied at an acute angle with respect to a horizontal reference axis 32 passing through hook 17. The angle formed between tension force 30 and horizontal reference axis 32 can be less than or equal to a critical angle 34 at which latch hook portion 26 becomes disengaged with cargo vessel 12.

Figure 4:
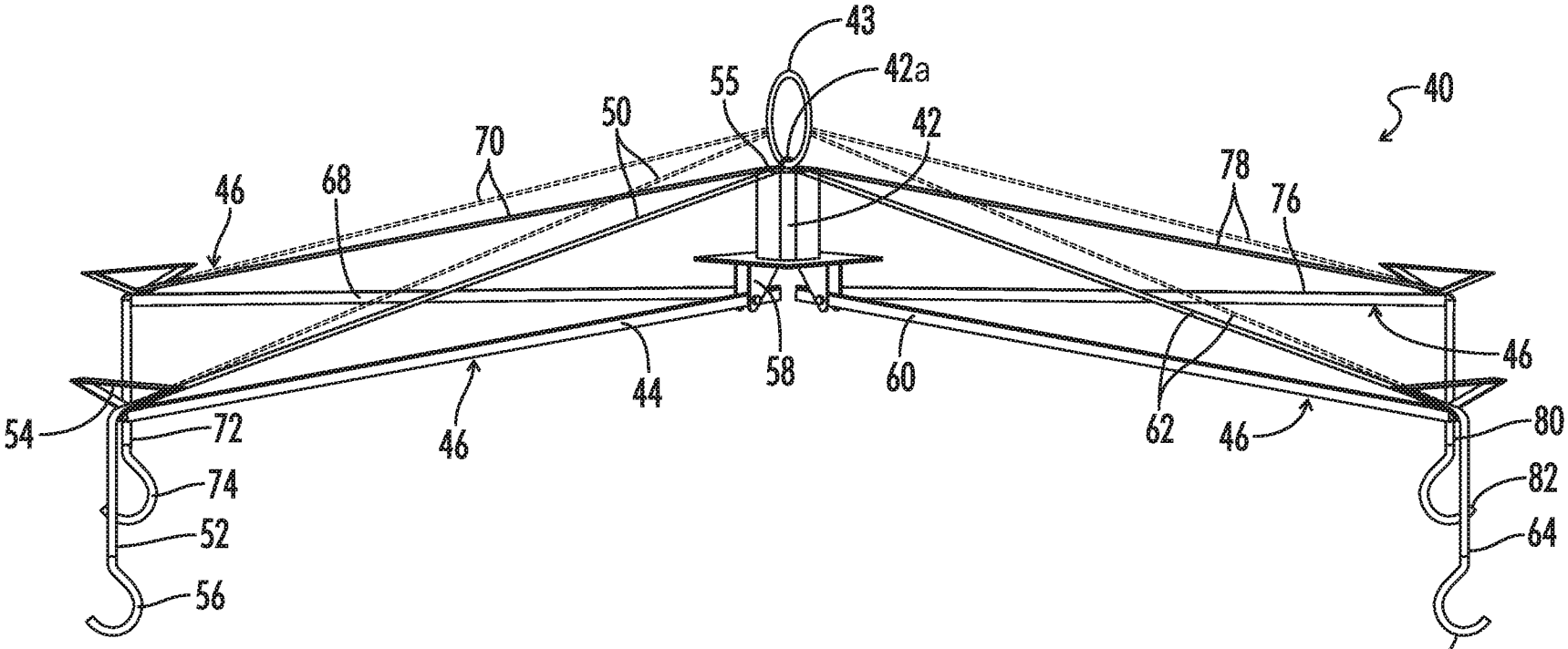
FIG. 4 is a perspective view of an embodiment of a cargo vessel lid moving apparatus.
Figure 5:
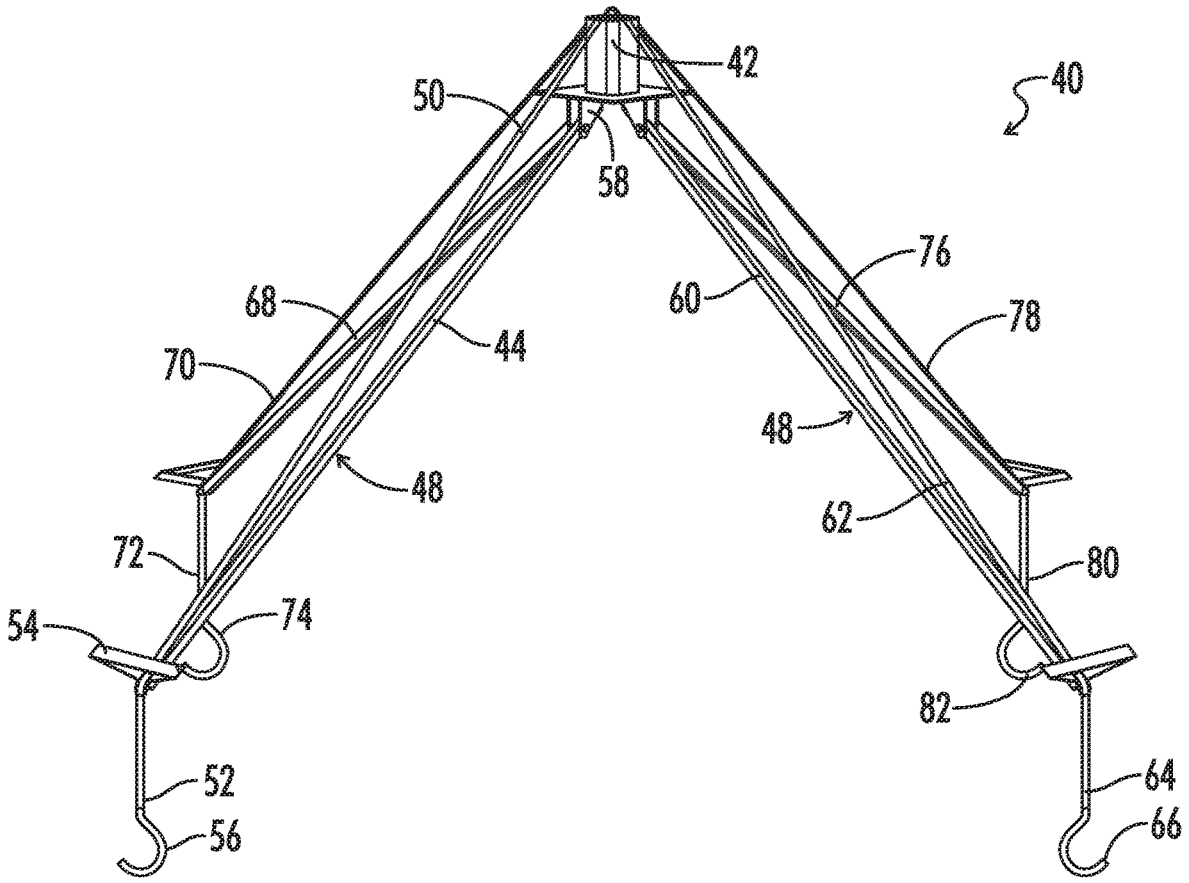
FIG. 5 is a perspective view of the embodiment of FIG. 4 with guide arms in a partially lowered position.

An embodiment of a cargo vessel lid removal apparatus 40 of the present disclosure is shown in FIG. 4 and FIG. 5. Apparatus 40 can include a base 42 with a guide arm 44 pivotable with respect to base 42. Guide arm 44 can be movable between a raised position 46, shown in FIG. 4, and a lowered position 48, shown in FIG. 5. A tension linkage 50 having a distal end 52 extending away from base 42 can be supported by guide arm 44 when guide arm 44 is in raised position 46. A tension linkage guide 54 can be disposed on guide arm 44. Tension linkage guide 54 can be movable along tension linkage 50 as guide arm 44 moves between raised position 46 and lowered position 48. In some embodiments, tension linkage 50 can extend through tension linkage guide 54. A lid hook 56 can be connected to distal end 52 of tension linkage 50.

Tension linkage 50 can be any suitable tension linkage 50 for supporting the weight of the lid hook 56 and at least a portion of the weight of a lid when the apparatus 40 is engaged with the lid and the lid is being removed from the cargo vessel. Tension linkage 50 can include, but is not limited to, straps, chains, cables, wire, etc.

Base 42 and guide arm 44 can be made out of any suitable substantially rigid material that can support the weight of lid hook 56 when the apparatus 40 is not engaged with a lid. Such materials can include, but are not limited to, steel, stainless steel, aluminum, iron, cast iron, titanium, etc.

In FIGS. 4 and 5, guide arm 44 is pivotable relative to base 42 via a support flange 58 positioned generally at the bottom of base 42, the guide arm 44 pivotally disposed on support flange 58. In other embodiments, guide arm 44 can be pivotally disposed on the top of base 42 or on the side of base 42.

In some embodiments, apparatus 40 can further include a second guide arm 60 pivotable relative to base 42. Second guide arm 60 can also be movable between raised position 46 and lowered position 48. A second tension linkage 62 having a second distal end 64 extending away from base 42 can be supported by second guide arm 60 when second guide arm 60 is in raised position 46. A second lid hook 66 can be connected to second distal end 64 of second tension linkage 66.

In other embodiments, the apparatus 40 can further include a third guide arm 68 pivotable relative to base 42. Third guide arm 68 can also be movable between raised position 46 and lowered position 48. A third tension linkage 70 having a third distal end 72 extending away from base 42 can be supported by third guide arm 68 when third guide arm 68 is in raised position 46. A third lid hook 74 can be connected to third distal end 72 of third tension linkage 70.

In still other embodiments, the apparatus 40 can further include a fourth guide arm 76 pivotable relative to base 42. Fourth guide arm 76 can also be movable between raised position 46 and lowered position 48. A fourth tension linkage 78 having a fourth distal end 80 extending away from base 42 can be supported by fourth guide arm 76 when fourth guide arm 76 is in raised position 46. A fourth lid hook 82 can be connected to fourth distal end 80 of second tension linkage 78.

Guide arms 44, 60, 68, and 76 can extend radially outward from base 42 in a cross or X-shaped configuration, such that when apparatus 40 is positioned over a cargo vessel lid, two arms can extend toward each side of lid 10. As such, lid hooks 56, 66, 74, and 82 can engage the lid at four different locations, two on each side of the lid, to help provide balanced lifting of the lid. The four tensions linkages 50, 62, 70, and 78 together can carry substantially all of the weight of the lid when the guide arms 44, 60, 68, and 76 are in the lowered position.

Several features of guide arm 44, tension linkage 50, and lid hook 56 are described hereinafter. In those embodiments including multiple guide arms and corresponding tension linkages and lid hooks, the same features and concepts can be equally applicable to all corresponding sets of guide arms, tension linkages, and lid hooks.

Figure 6A:
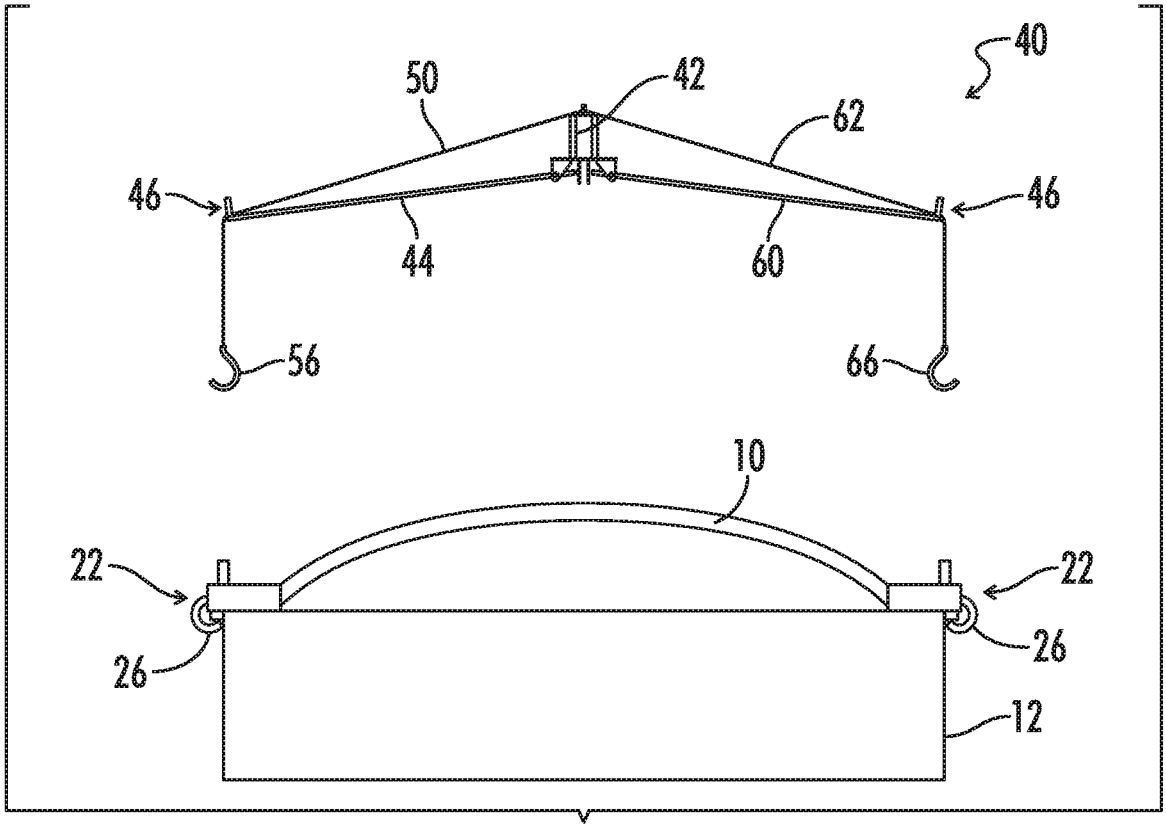
FIG. 6A is a side view of the embodiment of FIG. 4 in an elevated position over a cargo vessel including a lid.

FIGS. 6A-6D show side views of a progression of the apparatus 40 being used to remove a lid 10 from cargo vessel 12. Apparatus 40 can be used to remove a lid 10 from many different types of cargo vessels 12, including but not limited to, boats or barges, rail cars, tractor trailers, etc. Apparatus 40 is shown in FIG. 6A positioned over cargo vessel 12 and lid 10 with guide arms 44 and 60 in raised position 46 such that lid hooks 56 and 66 are positioned over latch members 22 on lid 10, latch members 22 being in a latched position on cargo vessel 12 with latch hook portions 26 engaging cargo vessel 12. Having guide arms 44 and 60 initially in raised position 46 can allow a crane or rigging system controlling the position of apparatus 40 to maneuver apparatus 40 such that lid hooks 56 and 66 are positioned over latch members 22 without an operator having to climb on lid 10 to retrieve tension linkages 50 and 62, and lid hooks 56 and 66.

Figure 6B:
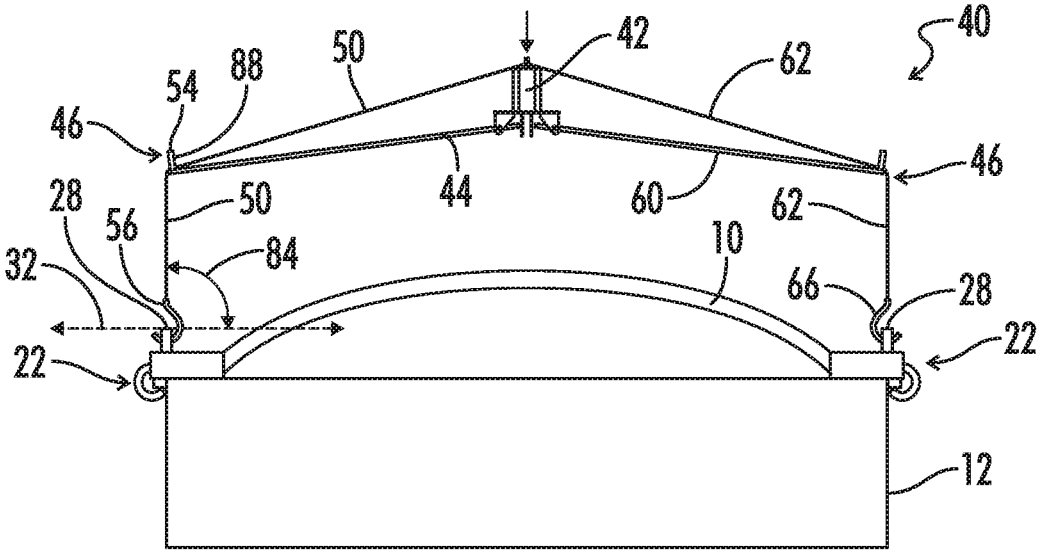
FIG. 6B is a side view of the embodiment of FIG. 4 in a downward position over a cargo vessel with the apparatus engaged with the cargo vessel lid.

Apparatus 40 is shown in FIG. 6B in a downward position such that lid hooks 56 and 66 engage latch lift eyelets 28. When lid hook 56 is engaged with lid 10 via latch member 22 and guide arm 44 is in raised position 46, tension linkage 50 can form a first tension angle 84 with respect to horizontal reference axis 32 passing through lid hook 56. In some embodiments, first tension angle 84 can be substantially ninety degrees such that tension linkage 50 applies a tension force in a generally upward direction such that latch member 22 remains engaged with cargo vessel 12.

Figure 6C:
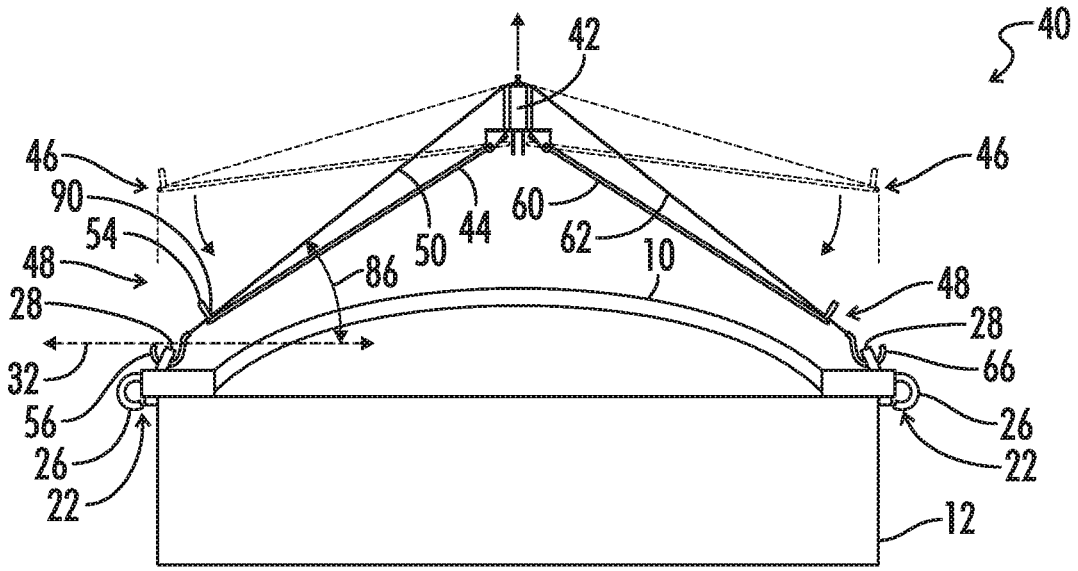
FIG. 6C is a side view of the embodiment of FIG. 4 being raised while the apparatus is engaged with the cargo vessel lid.

Apparatus 40 is shown in FIG. 6C as base 42 is being lifted in an upward direction with lid hooks 56 and 66 engaged with latch members 22. As base 42 is being lifted by a crane or other rigging device, guide arms 44 and 60 can move from raised position 46 to lowered position 48. When lid hook 56 is engaged with lid 10 via latch member 22 and guide arm 44 is in lowered position 48, tension linkage 50 can form a second tension angle 86 with respect to horizontal reference axis 32. Second tension angle 86 can be less than the first tension angle. Second tension angle 86 can also be less than critical angle 34 discussed in FIG. 3B such that when guide arm 44 is in lowered position 48 tension linkage 50 can apply an angled tension force on latch lift eyelet 28 such that latch member 22 rotates sufficiently to disengage latch hook portion 26 from cargo vessel 12.

Figure 6D:
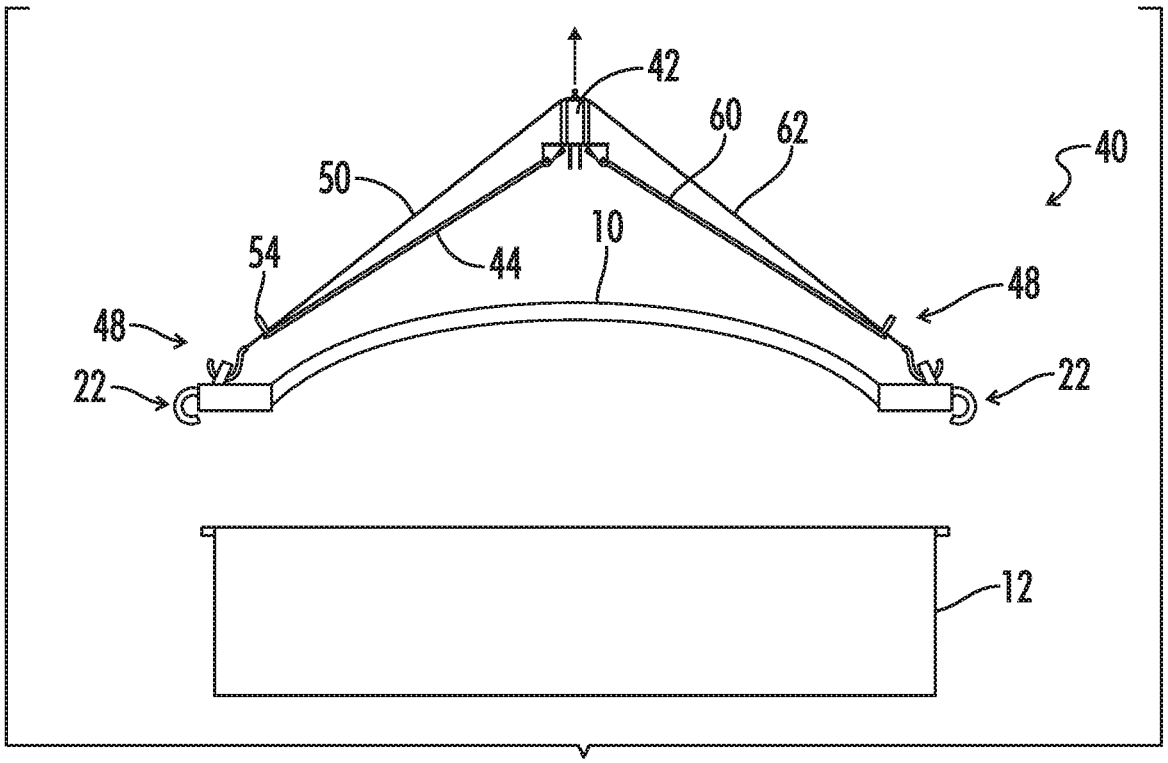
FIG. 6D is a side view of the embodiment of FIG. 4 lifting the cargo vessel lid off of the cargo vessel.

As such, when a crane or rigging member continues to lift base 42 and apparatus 40, lid 10 is thereby removed from cargo vessel 12 since latch member 22 is in an unlatched position, as shown in FIG. 6D. As can be seen from FIG. 6D, in some embodiments as lid 10 is being lifted and guide arm 44 is in lowered position 48, tension linkage 50 is generally straight or oriented 180 degrees with respect to itself along the entirety of tension linkage 50. As such, tension linkage 50 in some embodiments can apply a relatively small or non-existent downward force on guide arm 44 such that guide arm 44 generally does not support tension linkage 50, as opposed to the configuration seen when the guide arm is in the raised position and the tension linkage bends around the guide arm. As such, at least a portion of the weight or load of lid 10 is carried by tension linkage 50 as lid 10 is being lifted. In some embodiments, little to none of the weight of lid 10 is carried by guide arm 44 as lid 10 is being lifted. Such a configuration can help prevent fatigue of guide arm 44 such that the life of guide arm 44 can be extended. Such a configuration can also help prevent guide arm 44 from failing during use, which can potentially cause injury to people or property nearby. In those embodiments having multiple guide arms and multiple tension linkages, the tension linkages together can support substantially all of the weight of lid 10, such that substantially none of the weight of lid 10 is carried by the multiple guide arms as lid 10 is being lifted.

Additionally, in some embodiments guide arm 44 can be configured such that when guide arm 44 is in lowered position 48 and tension linkage 50 is in tension due to the weight of lid 10, tension linkage 50 can be centrally located within tension linkage guide 54 such that tension linkage 50 is not engaged with either guide arm 44 or tension linkage guide 54. In other embodiments, when guide arm 44 is in lowered position 48 and tension linkage 50 is in tension due to the weight of lid 10, a top portion of tension linkage guide 54 can rest on tension linkage 50 such that tension linkage 50 can support tension linkage guide 54, and effectively support a portion of the weight of guide arm 44.

Some conventional lifting systems use strap spreader devices that include a base which can be attached to a crane or rigging system. The base can be a rigid frame that extends outward from a crane hook or the base can have rigid arms that extend outward from a crane hook such that straps can be connected directly to outer ends of the base or the outer ends of the arms, which can facilitate connection of the straps to wider loads. However, because the straps are connected to the outer ends of the base or the outer ends of the arms, as the load is lifted, the straps produce considerable force on the base or the arms, and more particularly a large moment on the outer ends of the base or the outer ends of the arms. Such forces and moments can cause the base or arms to fatigue over time which can cause the base or arms to fail and potentially cause injury or damage to persons and property nearby. The configuration seen in FIG. 6D can help reduce the potential risk of base 42 or guide arms 44 failing, as the weight of lid 10 is carried predominantly by the tension linkages alone.

Referring again to FIG. 4, tension linkage 50 in some embodiments can have a proximate end 55 which can be connectable to the top 42*a* of base 42. In other embodiments, the apparatus 40 can include a lifting ring 43 engaged with the top 42*a* of the base 42 and proximate end 55 of tension linkage 50 can be connected directly to lifting ring 43, as shown by the dashed lines in FIG. 4, such that when lid 10 is lifted off of cargo vessel 12 and carried by tension linkage 50, neither base 42 nor guide arm 44 carries a substantial portion of the weight from lid 10. Rather, one or more tension linkages 50 and lifting ring 43, and ultimately the crane, can carry substantially all of the weight from lid 10, which can further help reduce failure of the base 42 and guide arm 44.

As can be seen from FIG. 6B and FIG. 6C, when guide arm 44 is in raised position 46, tension linkage guide 54 can engage tension linkage 50 at a first engagement position 88. When guide arm 44 is in lowered position 48, tension linkage guide 54 can engage tension linkage 50 at a second engagement position 90. As guide arm 44 moves from raised position 46 to lowered position 48, tension linkage guide 54 can move long tension linkage 50 from first engagement position 88 to second engagement position 90. Similarly, when guide arm 44 returns to raised position 48, tension linkage guide 54 can move along tension linkage 50 from second engagement position 90 back to first engagement position 88.

Figure 13A:
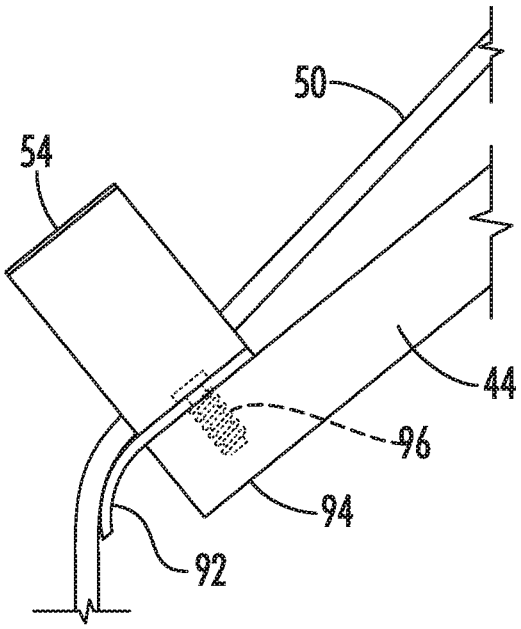
FIG. 13A is a detailed side view of a tension linkage guide of the embodiment of FIG. 5.

In some embodiments, tension linkage guide 54 can slide along tension linkage 50. Tension linkage guide 54 in such an embodiment can include a curved guide plate 92, as shown in FIG. 13A. As such, as the tension linkage guide 54 slides along tension linkage 50, curved guide plate 92 can engage tension linkage 50 such that a curved surface slides along tension linkage 50, as opposed to a pointed edge which can cause tension linkage 50 to wear and potentially break. In some embodiments, tension linkage guide 54 can be located near a guide arm distal end 94, and curved guide plate 92 can extend over guide arm distal end 94 such that tension linkage 50 can be protected from a pointed edge of guide arm distal end 94.

Additionally, in some embodiments, tension linkage guide 54 as well as curved guide plate 92 can be removable or replaceable on guide arm 44. Tension linkage guide 54 and curved guide plate 92 are shown disposed on guide arm 44 by a removable screw. As such, if tension linkage guide 54 or curved guide plate 92 were to break, they could efficiently and quickly be replaced with a new part, without having to replace the entire guide arm 44.

Figure 13B:
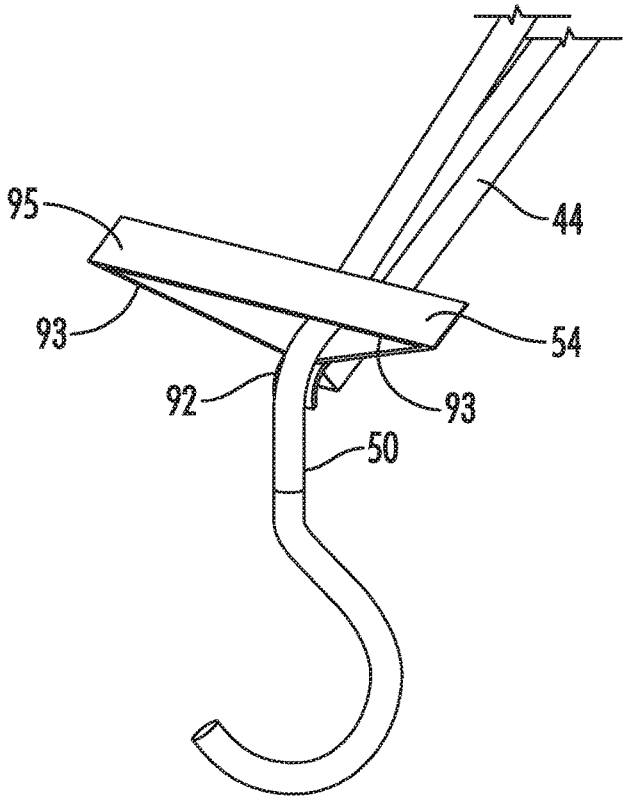
FIG. 13B is a detailed perspective view of a tension linkage guide of FIG. 5.

A perspective view of tension linkage guide 54 is shown in FIG. 13B. Tension linkage guide 54 in some embodiments can have a generally triangular shape. Tension linkage guide can have two opposing slanted sides 93 each slanting toward guide arm 44. As such, if tension linkage 50 contacts either slanting surface 93, tension linkage 50 can be guided toward a central location within tension linkage guide 54 and to a position over curved guide plate 92. Tension linkage guide 54 can also include a flat top side 95. In some embodiments, when guide arm 44 moves to a lowered position, the flat top side 95 of tension linkage guide 54 can rest on tension linkage 50 such that tension linkage 50 can support tension linkage guide 54 and effectively guide arm 44. While tension linkage guide 54 is shown in FIG. 13B having a triangular shape, tension linkage guide 54 can be any suitable shape, including but not limited to, square, rectangular, circular, oval, trapezoidal, polygonal, etc.

In other embodiments, tension linkage guide 54 can include a roller or pulley which can engage tension linkage 50 as tension linkage guide 54 moves along tension linkage 50. The roller can effectively allow tension linkage guide 54 to roll along tension linkage 50, which can help prevent wear of tension linkage 50.

Figure 7A:
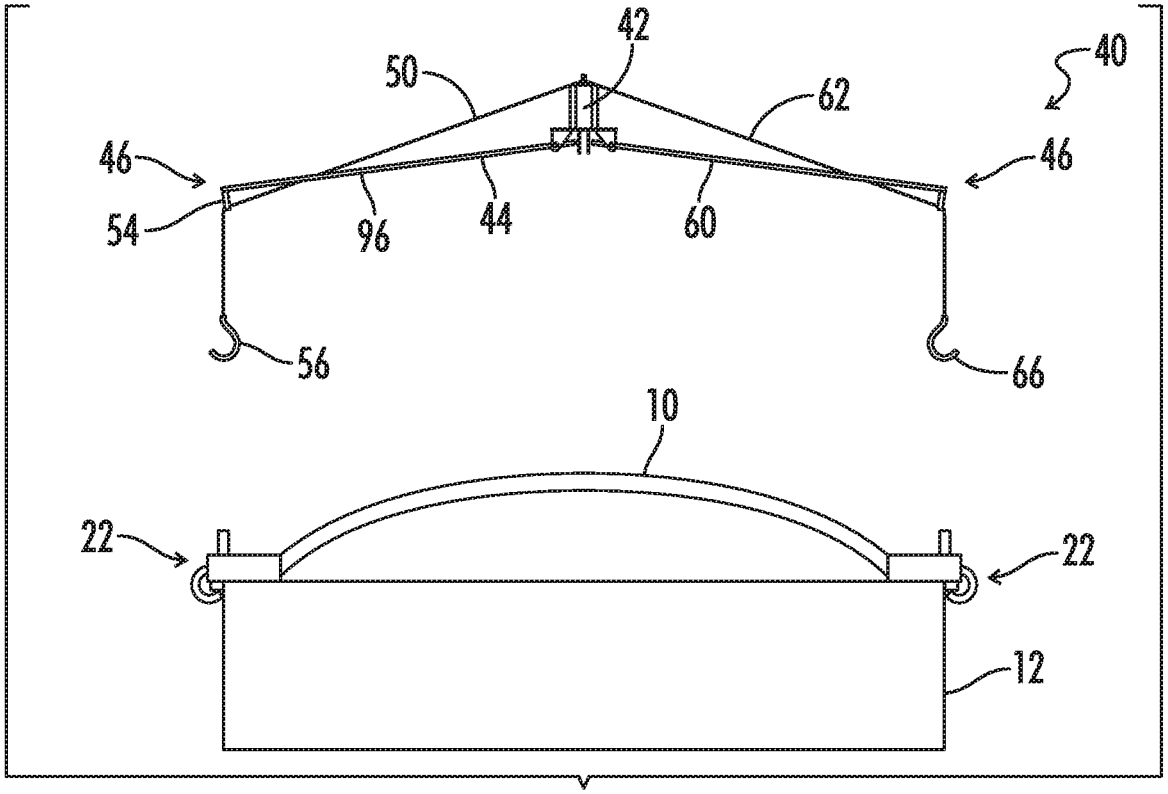
FIG. 7A is a side view of a second embodiment in an elevated position over a cargo vessel including a lid.
Figure 7B:
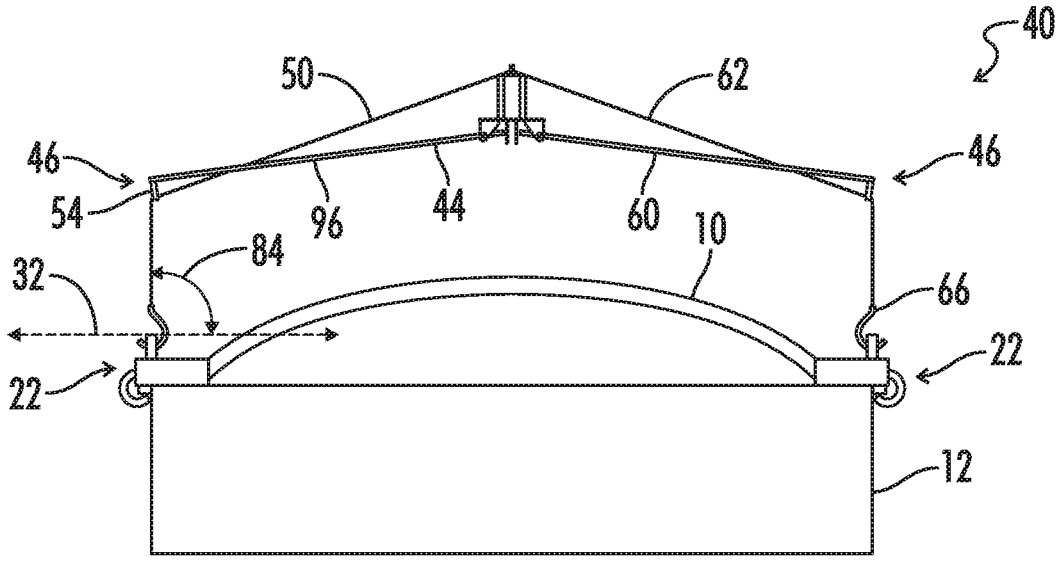
FIG. 7B is a side view of the embodiment of FIG. 7A in a downward position over a cargo vessel with the apparatus engaged with the cargo vessel lid.
Figure 7C:
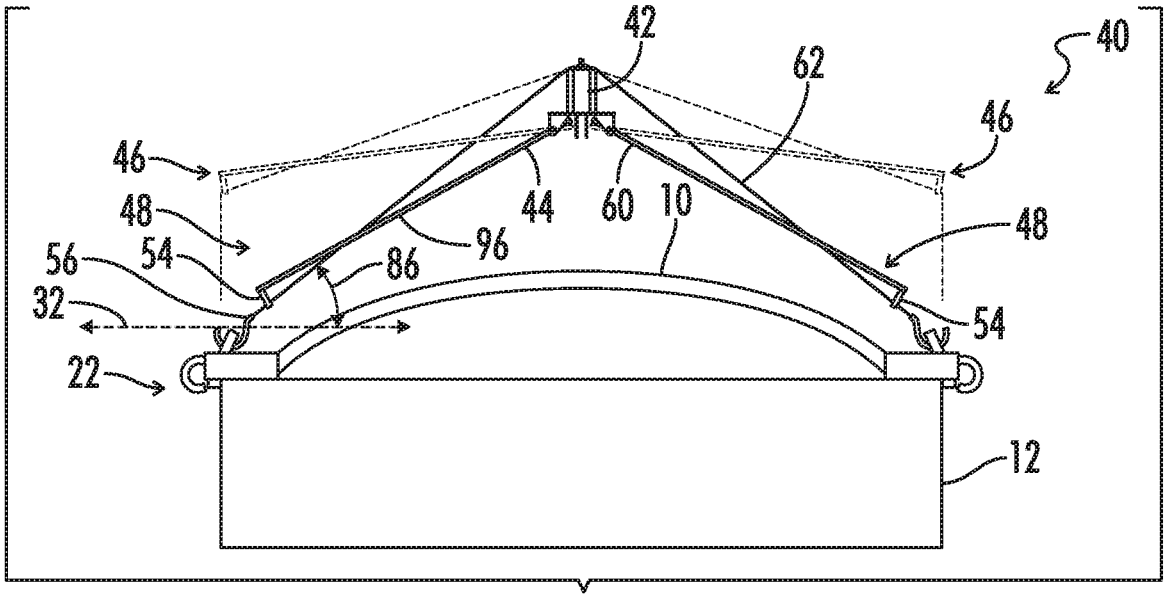
FIG. 7C is a side view of the embodiment of FIG. 7A being raised while the apparatus is engaged with the cargo vessel lid.

Another embodiment of apparatus 40 of the present disclosure is shown in FIG. 7A through 7D. As shown in FIG. 7A, tension linkage guide 54 can be positioned below guide arm 44. Guide arm 44 can include a longitudinal slot 96 extending through guide arm 44. Tension linkage 50 can pass through longitudinal slot 96 and further extend through tension linkage guide 54. In other embodiments, longitudinal slot 96 in guide arm 44 can act as tension linkage guide 54, tension linkage 50 extending through longitudinal slot 96 and extending directly downward toward latch member 22. Apparatus 40 can then be lowered by a crane or other rigging device to engage latch members 22 on lid 10 as shown in FIG. 7B.

Figure 7D:
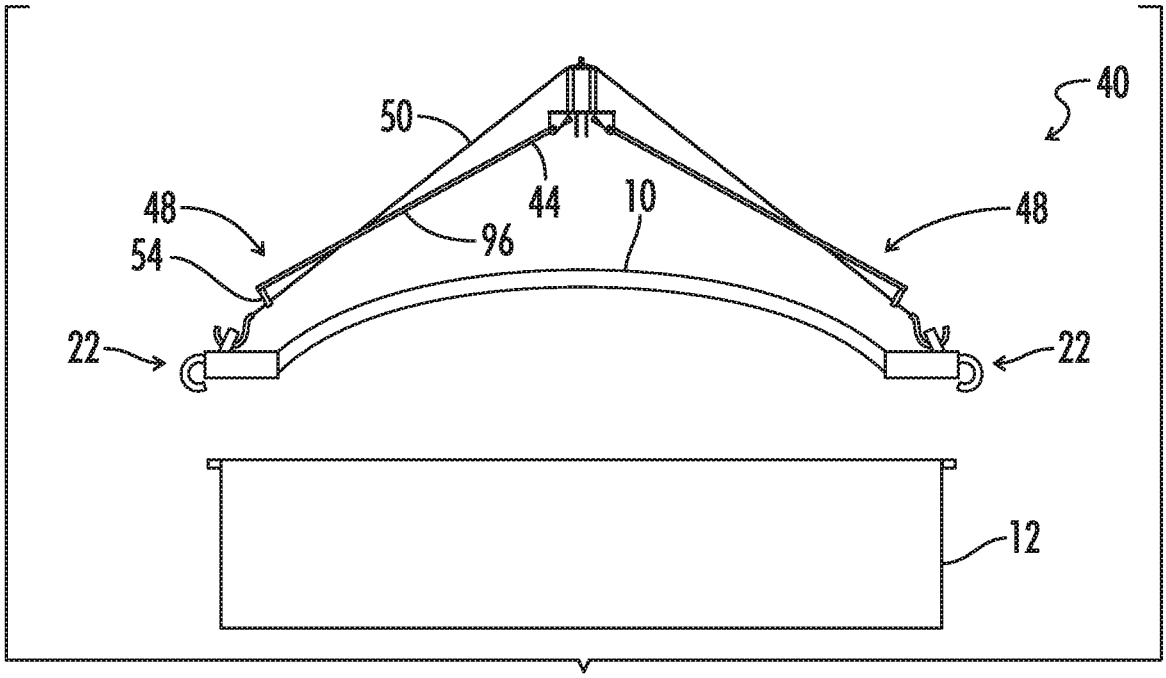
FIG. 7D is a side view of the embodiment of FIG. 7A lifting the cargo vessel lid off of the cargo vessel.

As apparatus 40 is raised by a crane or lifting device, as shown in FIG. 7C, guide arm 44 can again move from raised position 46 to lowered position 48. As such, tension angle formed by tension linkage 50 with respect to horizontal reference axis 32 passing through lid hook 56 can be decreased from a first tension angle 84 shown in FIG. 7B, to a second tension angle 86 shown in FIG. 7C, such that to latch member 22 can be disengaged from cargo vessel 12. In some embodiments, when guide arm 44 is in lowered position 46 and tension linkage 50 is in tension from the weight of lid 50, as shown in FIG. 7D, tension linkage 50 can again be substantially straight such that guide arm 44 does not support tension linkage 50. Additionally, in some embodiments, tension linkage 50 can be disengaged from both tension linkage guide 54 and guide arm 44 such that tension linkage 50 "floats" within longitudinal slot 96 and tension linkage guide 54.

Figure 8:
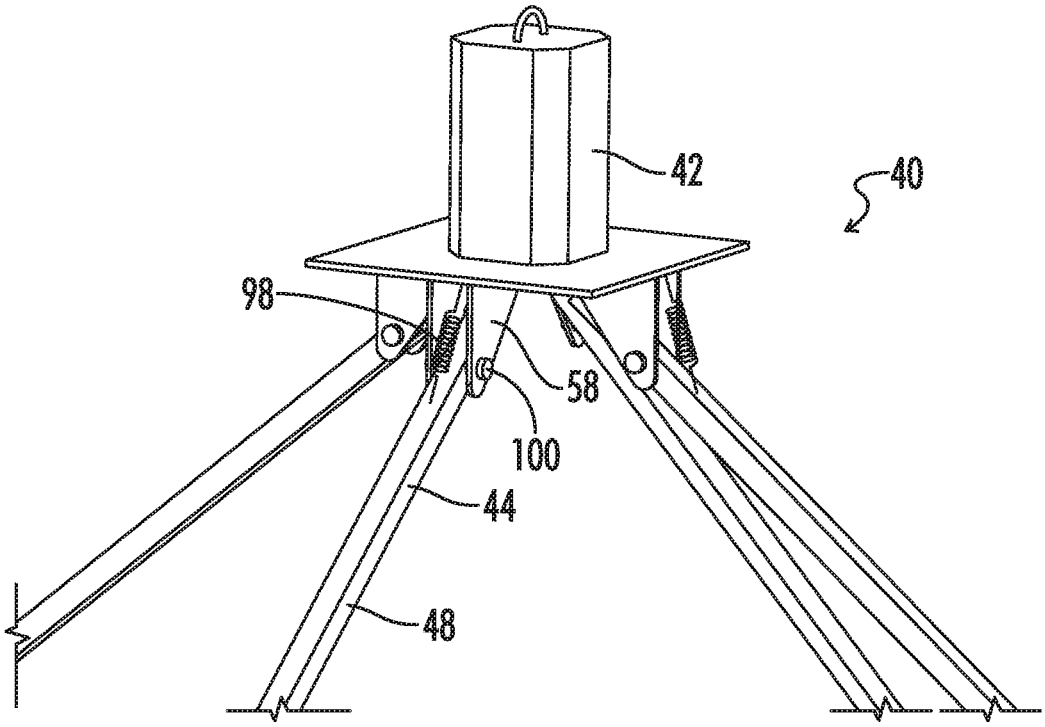
FIG. 8 is a perspective view of another embodiment with the guide arm biased in the raised position.

Another embodiment of apparatus 40 is shown in FIG. 8. A spring 98 can be connected between base 42 and guide arm 44 such that guide arm 44 is biased in the raised position. When the lid hook is engaged with the lid and base 42 is lifting by a crane, rigging unit, or other lifting device, the tension linkage can be placed in tension from the weight of the lid. The tension linkage 50 can apply a downward force on guide arm 44 such that guide arm 44 moves to lowered position 48 against the force of spring 98. In lowered position 48, guide arm 44 can be in equilibrium between forces acting on guide arm 44 from the tension linkage and spring 98. In some embodiments, when guide arm 44 is in equilibrium at lowered position 48, the tension linkage can be substantially straight such that guide arm 44 does not support the tension linkage and guide arm supports substantially none of the weight from the lid. When the lid is subsequently disengaged from apparatus 40, and the downward force from the tension linkage is removed, spring 98 can return guide arm 44 to the raised position.

Guide arm 44 in FIG. 8 is shown in lowered position 48, and spring 98 is a tension spring which is connected to base 42 and to a location on guide arm 44 outward from guide arm pivot point 100. Spring 98 can then be stretched as guide arm 44 moves to lowered position 48. In other embodiments, spring 98 can be a compression spring located between base 42 and a location on guide arm 44 inward from guide arm pivot point 100, such that spring 98 is compressed as guide arm 44 moves to lowered position 48. While several orientations have been described herein, spring 98 can be any type of spring and spring 98 can be connected between base 42 and guide arm 44 in any suitable manner such that spring 98 biases guide arm 44 in the raised position.

Figure 9:
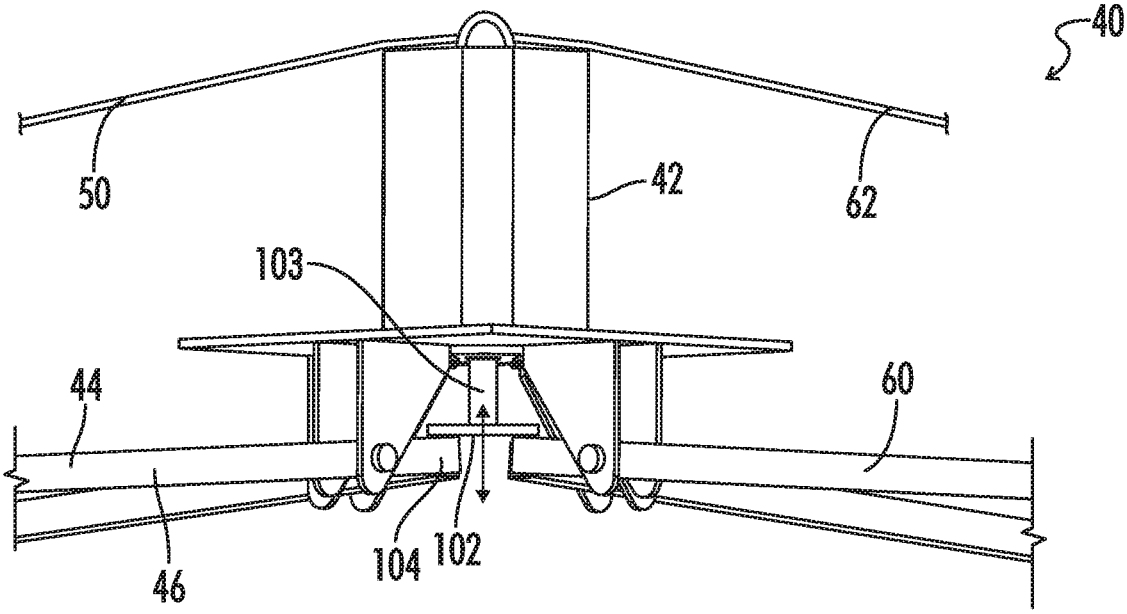
FIG. 9 is a perspective view of another embodiment including a plate movably disposed on the base, the plate in an extended position.
Figure 11A:
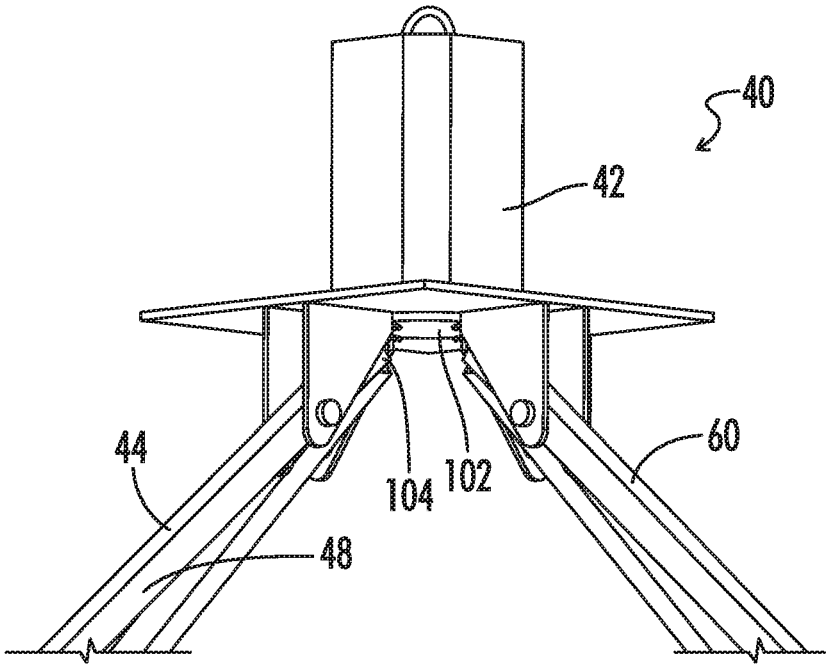
FIG. 11A is a perspective view of the embodiment of FIG. 9 with the plate in a retracted position.

Another embodiment of apparatus 40 is shown in FIG. 9. Apparatus 40 can include a plate 102 movably disposed on base 42. Plate 102 can be configured to selectively move guide arm 44 between the raised position and the lowered position. In FIG. 9, plate 102 is shown having an extension shaft 103 disposed in base 42, such that extension shaft 103 can extend in and out of base 42, thereby moving plate 102 up and down. In FIG. 9, extension shaft 103 can be extended such that plate 102 pushes a proximate end 104 of guide arm 44 downward to move guide arm 44 to raised position 46. As extension shaft 103 is retracted into base 42, plate 102 moves upward, and the natural weight of guide arm 44 will cause guide arm 44 to move to lowered position 48, as shown in FIG. 11A. In other embodiments, plate 102 can generally be disposed on base 42 such that extension shaft extends below guide arm 44, and extension shaft can be retracted in order to pull plate 102, and effectively proximate end 104 of guide arm 44, downward to move guide arm 44 to raised position 46.

Figure 10:
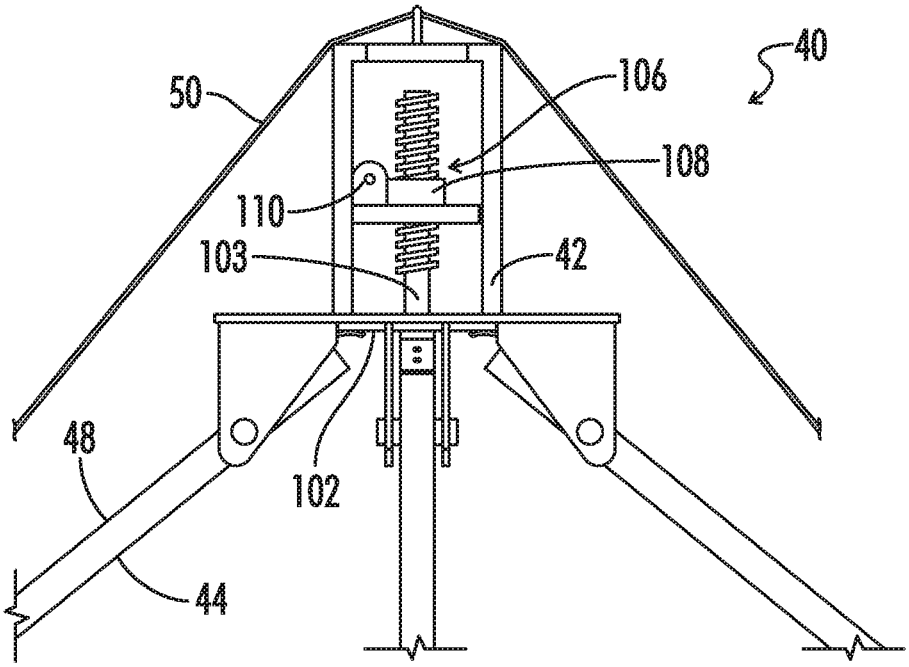
FIG. 10 is a cross sectional view of the embodiment of FIG. 9 including a actuator operable to control movement of the plate.

A cross-sectional view of an embodiment of base 42 from FIG. 9 is shown in FIG. 10. Apparatus 40 in some embodiments can further include an actuator 106 which can be operable to control the movement of plate 102 with respect to base 42. As such, by controlling the movement of plate 102, actuator 106 can control the movement of guide arm 44. In FIG. 10, extension shaft 103 is threaded, and actuator 106 is depicted as a jack screw 108 driven by a motor 110, jackscrew 108 moving extension shaft 103 in and out of base 42. In other embodiments, actuator 106 can be a hydraulic or pneumatic system such as a hydraulic or pneumatic piston which can control the movement of plate 102.

In some embodiments, electrical wires can be fed up the boom of a crane and connected to actuator 106 such that actuator 106 can be controlled directly from the crane operator cabin. In other embodiments, actuator 106 can include wireless telemetry equipment such that actuator 106 can be controlled wirelessly by either a crane operator or another operator on shore. Wireless control of actuator 106 can remove the need for wiring which can interfere with the operation of the crane or apparatus 40. In some embodiments, actuator 106 can be programmed to raise or lower guide arm 44 in response to a raising or lowering of the crane itself. For instance, when apparatus 40 is hooked to the lid and the crane begins to lift, actuator 106 can simultaneously cause guide arm 44 to move to lowered position 48.

Figure 11B:
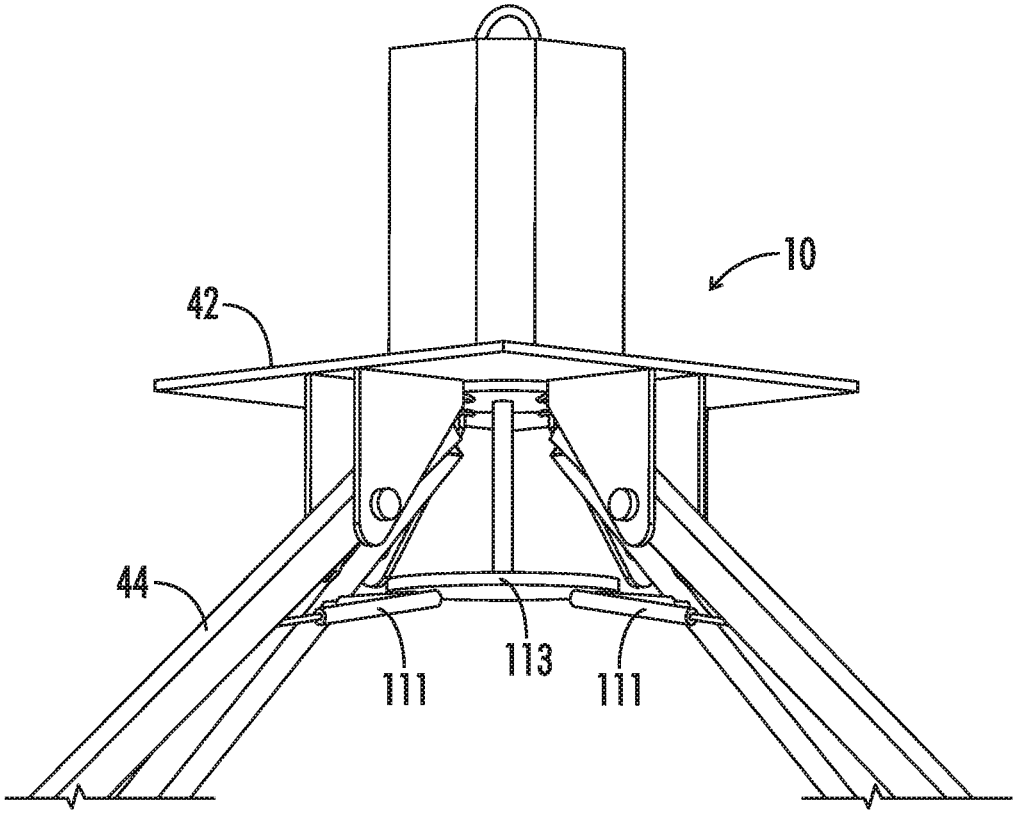
FIG. 11B is a perspective view of another embodiment of a cargo lid moving apparatus including a damper system connected to the guide arm.

Another embodiment of a cargo vessel lid moving apparatus is shown in FIG. 11B. The apparatus 40 can include a damper system 111 which can help control the movement of the guide arm 44 between the raised position and the lowered position. Damper system 111 can be connected to a frame 113 extending from base 42, damper system 111 engaging guide arm 44 to control the movement of guide arm 44. Damper system 111 in some embodiments can include a damper piston, the damper piston sliding within a chamber carrying either gas or liquid. As guide arm 44 moves between the raised and the lowered position, guide arm 44 can move the damper piston within the chamber. The gas or liquid contained in the chamber can provide a force against the movement of the damper piston, thereby slowing down the movement of guide arm 44. As such, when the lid hook supports at least a portion of the weight of the lid, guide arm 44 can move to the lowered position at a control rate due to the damper system 111. Similarly, in those embodiments including a spring which biases guide arm 44 in the raised position, as the weight of the lid is removed, the spring can cause guide arm 44 to move back to the raised position quickly, the guide arm 44 or the associated lid hook potentially injuring those nearby. Damper system 111 in such embodiments can be configured to slow down the motion of guide arm 44 such that guide arm 44 returns to the raised position at a controlled rate, thereby helping reduce the potential for injury.

Additionally, in some embodiments, a similar piston system as previously described for FIG. 11B can be used to bias guide arm 44 in the raised position. The chamber can be pressurized with a certain amount of gas that can cause the piston in the chamber to bias guide arm 44 in the raised position. As the weight of the lid is applied to the lid hook, guide arm 44 will tend to move downward, the force from the weight of the lid causing the piston to move within the chamber and compress the gas in the vessel until the lowered position is reached. Once the weight of the lid is removed, the gas will be free to expand and force the piston and effectively guide arm 44 back to the raised position.

Figure 12:
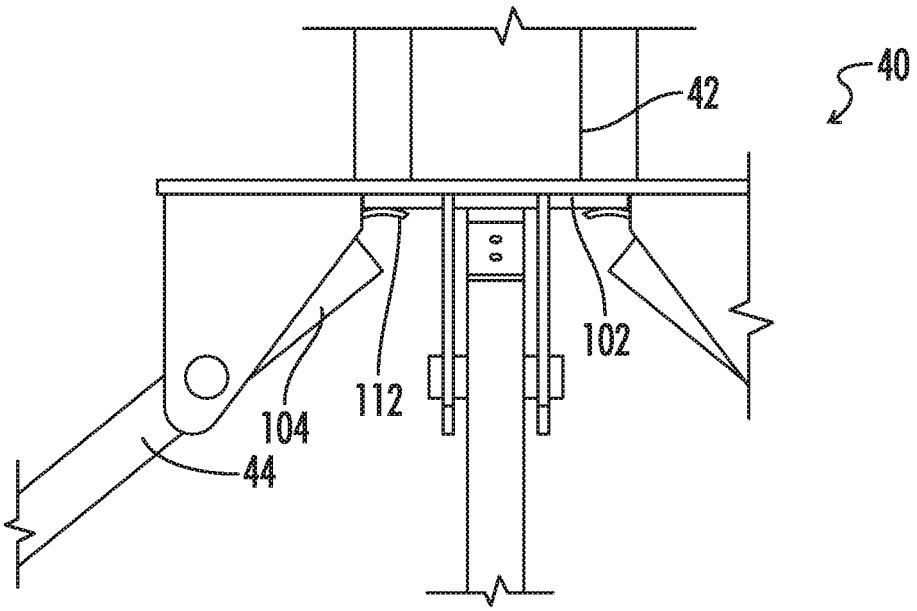
FIG. 12 is a detailed side view of the embodiment of FIG. 9.

A detailed side view of apparatus 40 is shown in FIG. 12. In some embodiments, proximate end 104 of guide arm 44 can have a curved contact plate 112 which can be configured to engage plate 102. As plate 102 moves up and down, and guide arm 44 rotates, curved contact plate 112 can roll on plate 102 such that plate 102 engages a rounded surface as opposed to a pointed edge, which can help reduce wear of plate 102. Additionally, in some embodiments, curved contact plate 112 can include a pad positioned between curved contact plate 112 and plate 102 to help additionally help prevent wear on plate 102. Curved contact plate 112 can be removably connected to proximate end 104 of guide arm 44 by a screw or other suitable manner such that if curved contact plate 112 breaks or fails, a new curved contact plate 112 can be connected quickly and efficiently without having to replace guide arm 44.

Figure 14:
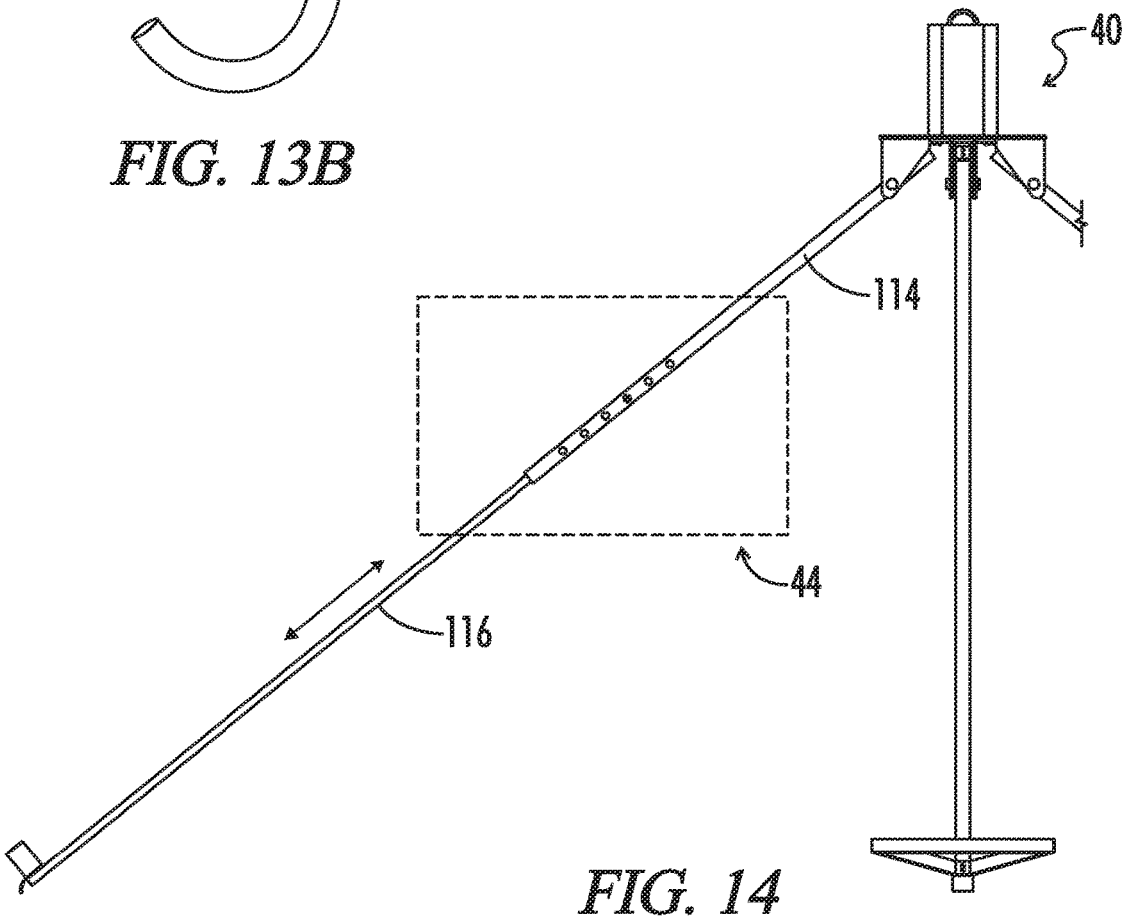
FIG. 14 is a detailed side view of another embodiment having a telescoping arm.

In some embodiments, as shown in FIG. 14, guide arm 44 can be a telescoping arm. Guide arm 44 can have a first portion 114 and a second portion 116. Second portion 116 can be configured to fit inside first portion 114 such that second portion 116 can slide in and out of first portion 114 in order to adjust the overall length of guide arm 44. An adjustable guide arm 44 can be beneficial as the length of guide arm 44 can be adjusted in order to engage lids 10 of different shapes and sizes. While typically cargo vessel lids can be made according to certain industry standards, industry standards can potentially vary across different countries or across different markets. As such, having a telescoping guide arm 44 as seen in FIG. 14 can allow apparatus 40 to be used to remove lids of varying sizes by adjusting the length of guide arm 44.

Figure 15:
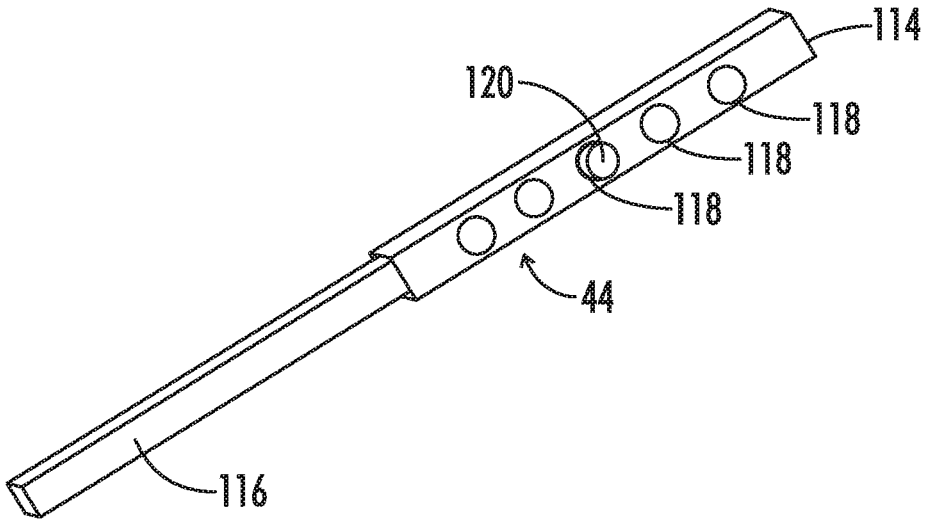
FIG. 15 is a detailed perspective view of the telescoping arm of FIG. 14.

FIG. 15 shows a detailed view of a first embodiment of a telescoping guide arm 44 which can be manually adjusted. First portion 114 of guide arm 44 has a plurality of holes 118 in one or more sides of first portion 114, and second portion 116 has a push button 120 that can be received through plurality of holes 118. To adjust the length of guide arm 44, and the position of second portion 116 relative to first portion 114, an operator can manually press push button 120 through an initial hole 118, and second portion 116 can then slide within first portion 114 until push button 120 is received through a desired hole 118. The positions of each hole 118 can be configured to produce an overall guide arm 44 length suitable for a certain sized lid 10. In other embodiments, second portion 116 can include a through hole which is parallel to the plurality of holes 118 in first portion 114, and a pin can be inserted through a specific hole 18 and the through hole in second portion 116 to lock second portion 116 in a desired position relative to first portion 114.

Figure 16:
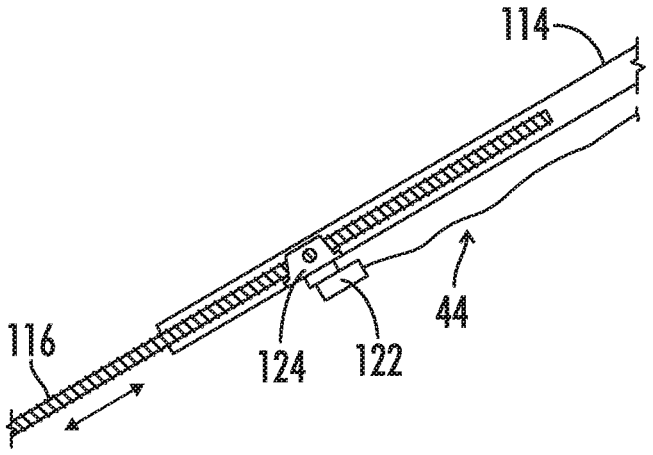
FIG. 16 is a detailed perspective view of another embodiment of a telescoping arm.

FIG. 16 shows a second embodiment of a telescoping guide arm 44. Second portion 116 can be threaded such that movement of second portion 116 within first portion 114 can be controlled by a telescoping arm motor 122 and a gear system 124 engaged with second portion 116. Second portion 116 being threaded allows second portion 116 to be located at infinitely many positions within first portion 114 which can allow guide arm 44 to be used for lids of infinitely many sizes. In additional embodiments, the position of second portion 116 within first portion 114 can be controlled using a pneumatic control system or a hydraulic control system. Additionally, the telescoping arm motor 122 can be electrically connected to the controls of a crane, such that the length of guide arm 44 can be controlled from the crane operating cabin. In other embodiments, telescoping arm motor 122 can include wireless telemetry equipment such that telescoping arm motor can be controlled wirelessly by a crane operator or another operator on shore.

An additional benefit of a telescoping guide arm 44, and particularly a motorized telescoping guide arm, is that when apparatus 40 is being raised by a crane to remove a lid from a cargo vessel, and guide arm 44 moves from a raised position to a lowered position, telescoping guide arm 44 can retract such that the tension linkage can more quickly achieve a substantially straight orientation, and the weight of the lid can be more quickly removed from guide arm 44. Additionally, retracting telescoping guide arm 44 when guide arm 44 moves to a lowered position can help prevent a top surface of a lid from interfering with the movement of guide arm 44.

Figure 17A:
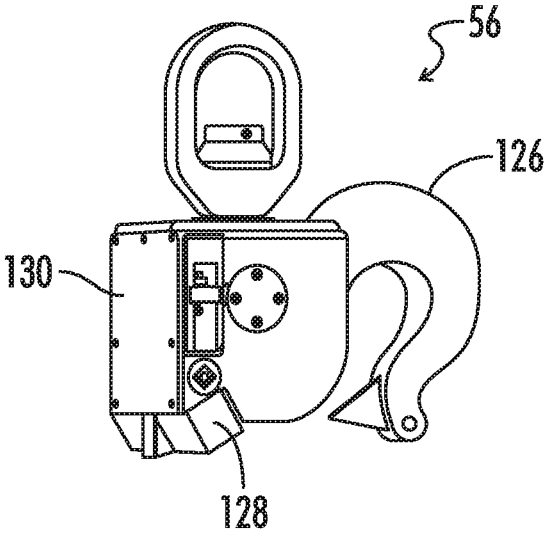
FIG. 17A is a perspective view of an embodiment of a lid hook in an unhooked position.
Figure 17B:
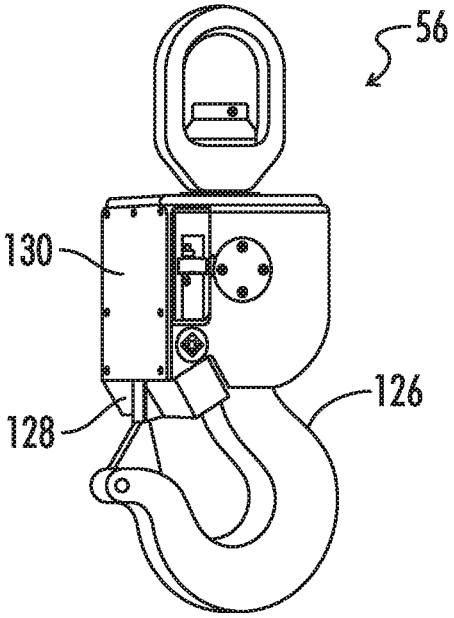
FIG. 17B is a perspective view of the lid hook of FIG. 17A in a hooked position.

One embodiment of an automated lid hook 56 for apparatus 40 is shown in FIG. 17A. Lid hook 56 can be configured similar to an Elebia® hook generally known in the art. Lid hook 56 can include an automated pivoting hook member 126 that is movable between a retracted position and a hooked position. Lid hook 56 is shown in a retracted position in FIG. 17A, and a hooked position in FIG. 17B. Lid hook 56 can include an electromagnet 128 which when activated can cause lid hook 56 to attract or be attracted to a desired metal object, such as a latch lift eyelet on a latch member of a lid. Electromagnet 128 can also be configured to cause lid hook 56 to properly align itself with the latch lift eyelet such that when pivoting hook member 126 rotates to a hooked position, pivoting hook member 126 properly engages the latch lift eyelet.

As such, with lid hook 56 of FIG. 17A connected to the tension linkage, a crane operator can lower the lid removal apparatus with the guide arm in the raised position such that lid hook 56 can be located generally over the latch member, with the pivoting hook member 126 being in a retracted position. With electromagnet 128 activated, as lid hook 56 approaches the latch member, lid hook 56 can be attracted to the latch lift eyelet and electromagnet 128 can contact the latch lift eyelet. Electromagnet 128 can then orient lid hook 56 in a proper alignment with latch lift eyelet 28. Pivoting hook member 126 can then be rotated to a hooked position such that pivoting hook member 126 engages the latch lift eyelet. The operator can then lift the lid removal apparatus such that the lid can be removed from the cargo vessel as previously described.

As such, lid hook 56 can be connected to a latch member of a lid without an operator having to walk around the cargo vessel and manually attach lid hook 56 to the latch member. Such a system can help reduce the risk of injury from operators being in the work space of the crane or the risk of injury of tripping or falling while walking around the cargo vessel, particularly in a barge vessel application, where a fall could result in an operator falling overboard into the water. Such a system also potentially allows the lifting of the lid to be done by a lone crane operator, which can help increase the efficiency of the process as fewer people are needed.

In some embodiments, lid hook 56 can have a rechargeable battery 130. A rechargeable battery 130 allows lid hook 16 to be powered without having to connect lid hook 56 to a separate power supply. Such a configuration can help prevent interference of wires with the operation of the lid removal apparatus and the operation of the crane. Additionally, in some embodiments lid hook 56 can be equipped with wireless telemetry equipment, such that lid hook 56 and particularly the movement of the pivoting hook member 126 can be controlled wirelessly by a crane operator or another operator standing away from cargo vessel 12.

Figure 18:
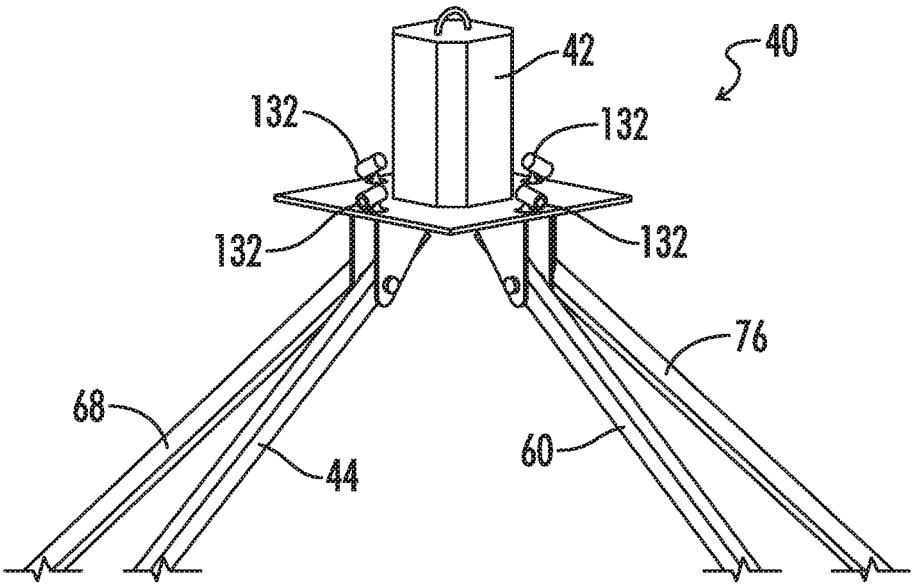
FIG. 18 is a perspective view of another embodiment with a guide camera mounted on a base.
Figure 19:
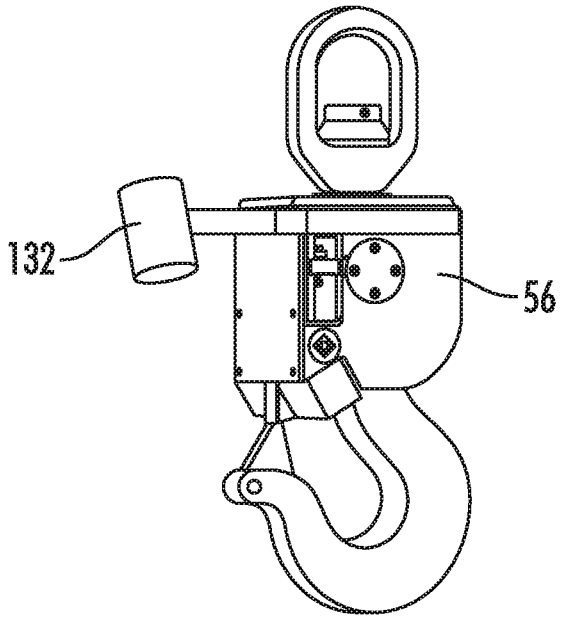
FIG. 19 is a perspective view of the lid hook of FIG. 17B with a camera located proximate the lid hook.
Figure 20:
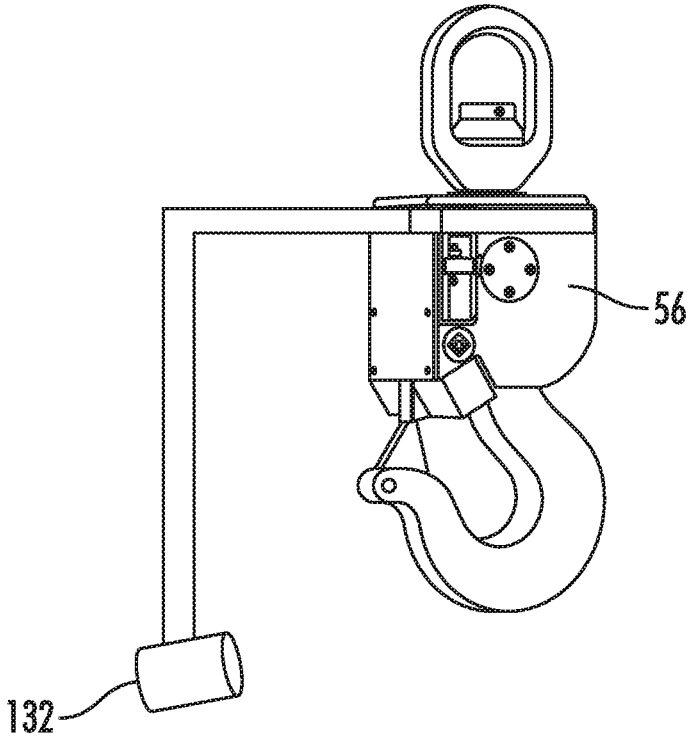
FIG. 20 is a perspective view of another embodiment of a camera located proximate the lid hook of FIG. 17A.

Additionally, in some embodiments, apparatus 40 can include one or more guide cameras 132, as shown in FIGS. 18-20. In FIG. 18, guide cameras 132 are positioned or mounted on base 42. Each guide camera 132 can be oriented to view the position of a corresponding lid hook and guide arm. The feed from each camera 132 can be run to monitors located in the operating cabin of the crane, such that a crane operator can view the position of the lid hooks as the operator manipulates the lid removal apparatus. Guide cameras 132 can be particularly helpful to view lid hooks and latch members on a far side of the lid from the crane operator, as the lid can have a rounded top surface which can obstruct an operator's view of the far side of the lid. Guide cameras 132 can additionally have wireless telemetry equipment in some embodiments such that guide cameras 132 can communicate wirelessly with the monitors placed in the operator's cabin on the crane.

In another embodiment, as shown in FIGS. 19 and 20, guide camera 132 can be disposed proximate lid hook 56. FIGS. 19 and 20 show guide camera 132 disposed directly on lid hook 56. In some embodiments, guide camera 132 could also be positioned on the guide arm in a position generally over lid hook 56. Such a configuration can show a closer view of the position of lid hook 56 with respect to a lid and a corresponding latch member. Additionally, in some embodiments as shown in FIG. 20, guide camera 132 can be positioned below lid hook 56. Such a configuration can be beneficial when the apparatus is being used to place a lid onto a cargo vessel, as guide camera 132 can then be used to view the position of the lid on the cargo vessel, as well as the engagement of a corresponding latch member with the cargo vessel.

Figure 21:
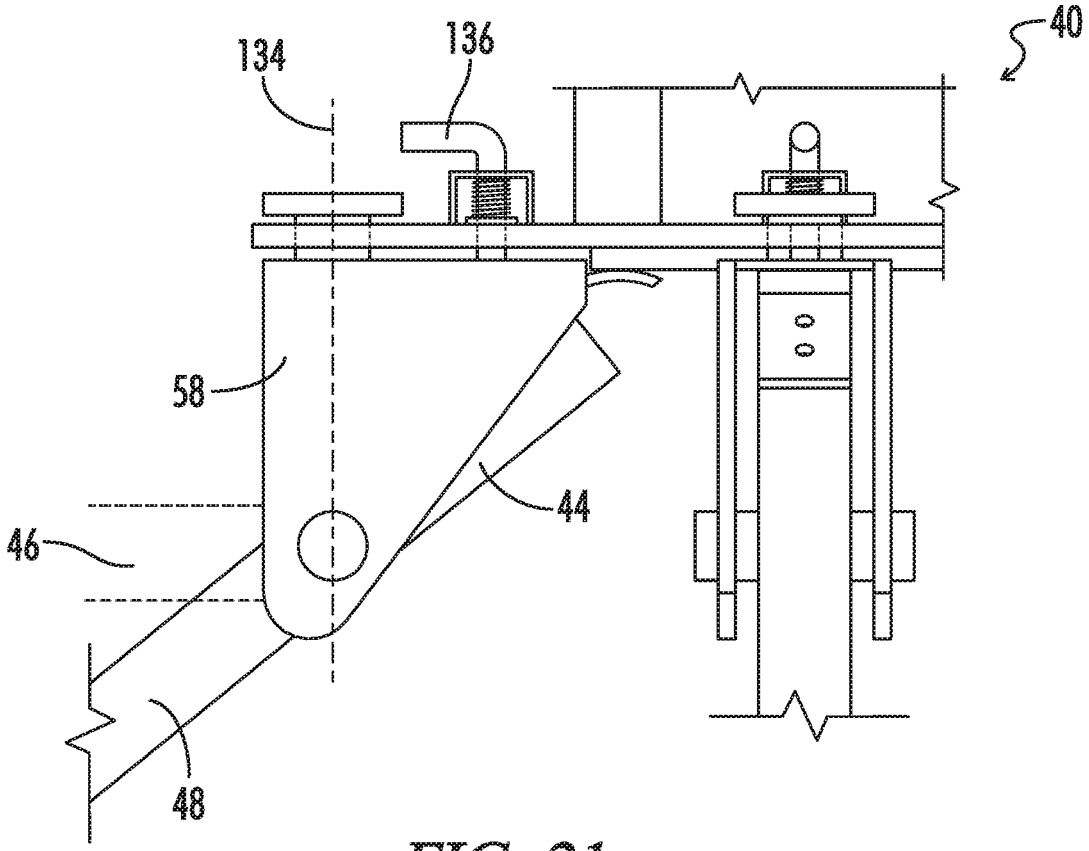
FIG. 21 is a detailed side view of another embodiment having a base with a rotatable support flange.

In some embodiments, as shown in FIG. 21, support flange 58 can have a flange vertical reference axis 134. Guide arm 44 can be pivotally disposed on support flange 58 and movable on support flange 58 between raised position 46 and lowered position 48. Support flange 58 in some embodiments can be rotatable about flange vertical reference axis 134, such that guide arm 44 can be angularly rotated about flange vertical reference axis 134. Such a configuration can allow guide arm 44 to be adjusted in order to accommodate lids having latch members at different or varying points along the lid. As such, if latch members on a particular lid are spaced apart differently than on the previous lid, support flange 58 and guide arm 44 can be rotated about flange vertical reference axis 134 such that guide arm 44 can extend in a suitable direction toward a particular latch member. Apparatus 40 can then be used to remove lids having different sizes or different latch member configurations.

Figure 22:
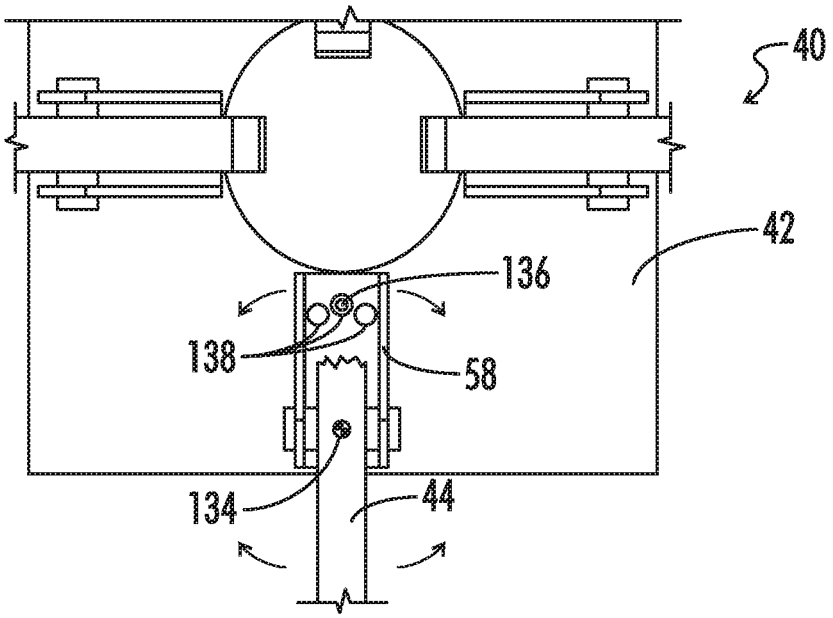
FIG. 22 is a detailed bottom view of the embodiment of FIG. 21.

In some embodiments, base 42 can include a spring biased pin 136 which can be configured to selectively engage support flange 58 in order to lock support flange 58 in different angular positions, as can be seen in FIGS. 21 and 22. Support flange 58 can include a plurality of flange holes 138, spring biased pin 136 being received through flange holes 138. An operator can manually pull upward on spring biased pin 136, initially in one flange hole 138, such that support flange 58 can be rotated about flange vertical reference axis 134. Spring biased pin 136 can then be released such that it is received by a different flange hole 138 and support flange 58 is locked in a different angular position. The position of each flange hole 138 on support flange 58 can correspond to a different angular setting for a different industry standard sized lid or latch orientation.

Figure 23:
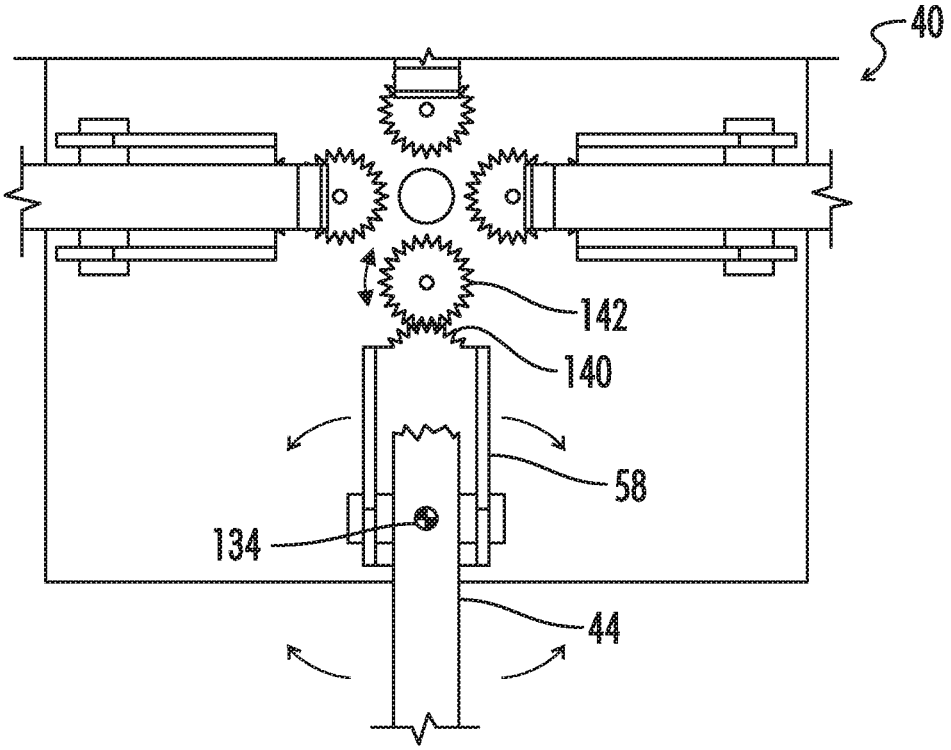
FIG. 23 is a detailed bottom view of another embodiment having a gear system which can move a rotatable support flange on the base.

Another embodiment of an angularly adjustable support flange 58 is shown in FIG. 23. Support flange 58 can include a gear portion 140. A flange drive gear 142 can be disposed on base 42. Flange drive gear 142 can be actuated by a motor or other device disposed on base 42. The actuation device can additionally be electrically connected with the crane controls such that the angular position of guide arm 44 with respect to flange vertical reference axis 134 can be adjusted from the crane operating cabin. The use of a gear system can potentially allow for infinitely many angular positions of support flange 58 and guide arm 44 such that apparatus 40 can accommodate lids of varying sizes or latch member orientations.

In still other embodiments, the guide arm can have first and second portions which are pivotal relative to one another, such that the second portion of the guide arm can pivot about the first portion of the guide arm in order to adjust the position of the lid hook over different latch member configurations. In such a configuration, support flange 58 can remain stationary on base 42, and the rotation of the second portion of the guide arm can provide the lateral angular adjustability for guide arm 44.

In still other embodiments, base 42 can be configured, manually or through a hydraulic or other mechanically suitable system, to be rotatable about a vertical axis extending through base 42. In some embodiments, base 42 can rotate through 360 degrees of rotation. As such, if base 42 is not in a proper alignment over the lid, base 42 can be rotated to orient itself in a proper alignment over the lid. Additionally, once the lid is lifted by the apparatus, having base 42 rotatable about itself can allow the orientation of the lid to be adjusted, which can be beneficial for instance when multiple lids are being stacked on top of one another and the lid needs to be properly aligned over a stack of lids.

Several aspects of the present disclosure have been described in some embodiments as having wireless telemetry, or have the capability of being communicated with or controlled wirelessly, such as the actuator for the movable plate, the telescoping arm actuation, the automated lid hooks, the guide cameras, etc. In some embodiments, the apparatus can include an electronic user interface in the form of a tablet, touch pad, or other suitable electronic device which can be used to control the previously mentioned functions of the apparatus all from the same device. The electronic user interface could also include a downloadable software application that could be downloaded to a suitable electronic device. The user interface can be mounted within the crane operator's cabin such that all aspects of the apparatus can be controlled by the crane operator. Additionally, the electronic control user interface could be a portable device that could be controlled either by a crane operator in the cabin or by an operator on the ground. Such a configuration can allow multiple aspects of the apparatus to be conveniently controlled from the same location or by the same person.

Another aspect of the present disclosure is a method of removing a cargo vessel lid from a cargo vessel, the method including providing a cargo vessel lid moving apparatus having: a base; a guide arm pivotable relative to the base, the guide arm movable between a raised position and a lowered position; a tension linkage having a distal end extending away from the base, the tension linkage supported by the guide arm when the guide arm is in the raised position; a tension linkage guide disposed on the guide arm, the tension linkage guide movable along the tension linkage; and a lid hook connected to the distal end of the tension linkage.

The method further includes: lowering the removal apparatus with the guide arm in the raised position; engaging the lid hook with the cargo vessel lid, the tension linkage forming a first tension angle with respect to a horizontal reference axis passing through the lid hook; moving the guide arm from the raised position to the lowered position; and raising the removal apparatus, the tension linkage forming a second tension angle with respect to the horizontal reference axis when the guide arm is in the lowered position, the second tension angle being less than the first tension angle.

In some embodiments, the raising step can be performed simultaneously with the moving step, such that the guide arm moves from the raised position to the lowered position as the removal apparatus is raised. In other embodiments, the guide arm can be moved to the lowered position before the removal apparatus is raised.

In additional embodiments, the cargo vessel lid can have a weight, and the tension linkage alone can support substantially all of the weight of the cargo vessel lid during the raising step when the guide arm is in the lowered position. In some embodiments, the guide arm does not support the tension linkage or the weight of the cargo vessel lid during the raising step.

In additional embodiments, the tension linkage guide can engage the tension linkage at a first engagement point when the guide arm is in the raised position. The tension linkage guide can engage the tension linkage at a second engagement point when the guide arm is in the second engagement position. Additionally, during the moving step, the tension linkage guide can move along the tension linkage from the first engagement point to the second engagement point.

Thus, although there have been described particular embodiments of the present invention of a new and useful Lifting System it is not intended that such references be construed as limitations upon the scope of this invention except as set forth in the following claims.

What is claimed is:

1. An apparatus for moving an object, the apparatus comprising:

a base;

a guide arm pivotable relative to the base, the guide arm movable between a raised position and a lowered position;

a tension linkage having a distal end extending away from the base, the tension linkage supported by the guide arm when the guide arm is in the raised position;

a tension linkage guide disposed on the guide arm, the tension linkage guide movable along the tension linkage as the guide arm moves between the raised position and the lowered position; and a hook connected to the distal end of the tension linkage;

the tension linkage forming a first tension angle with respect to a horizontal reference axis passing through the hook when the hook is engaged with the object and the guide arm is in the raised position;

the tension linkage forming a second tension angle with respect to the horizontal reference axis when the hook is engaged with the object and the guide arm is in the lowered position wherein the second tension angle is less than the first tension angle.

2. The apparatus of claim 1, wherein:

the tension linkage guide engages the tension linkage at a first engagement position when the guide arm is in the raised position;

the tension linkage guide engages the tension linkage at a second engagement position when the guide arm is in the lowered position; and the tension linkage guide is movable along the tension linkage between the first engagement position and the second engagement position when the guide arm moves from the raised position to the lowered position.

3. The apparatus of claim 1, wherein the tension linkage is not supported by the guide arm when the hook is engaged with the object and the guide arm is in the lowered position.

4. The apparatus of claim 1, wherein the guide arm is biased in the raised position.

5. The apparatus of claim 4, wherein:

the base is configured to be received on a lifting device; and the guide arm is configured to move from the raised position to the lowered position when the hook is engaged with the object and the base is lifted by the lifting device.

6. The apparatus of claim 1, further comprising a plate movably disposed on the base, the plate configured to selectively move the guide arm between the raised position and the lowered position.

7. The apparatus of claim 6, wherein the base further comprises an actuator operable to control the movement of the plate with respect to the base.

8. The apparatus of claim 1, wherein the guide arm is a telescoping arm.

9. The apparatus of claim 1, further comprising a guide camera mounted on the base.

10. The apparatus of claim 1, further comprising a guide camera located proximate the hook.

11. The apparatus of claim 1, wherein:

the base further comprises a support flange, the support flange having a flange vertical reference axis;

the guide arm is pivotally disposed on the support flange and movable on the support flange between the raised position and the lowered position; and the flange is rotatable about the flange vertical reference axis.

12. The apparatus of claim 1, further comprising:

a second guide arm pivotable relative to the base, the second guide arm movable between a raised position and a lowered position;

a second tension linkage having a second distal end extending away from the base, the second guide arm supporting the second tension linkage when the second guide arm is in the raised position; and a second hook connected to the second distal end of the second tension linkage.

13. The apparatus of claim 1, wherein the tension linkage guide further comprises a curved guide plate.

14. An apparatus for moving an object, the apparatus comprising:

a base;

a guide arm pivotable relative to the base, the guide arm movable between a raised position and a lowered position;

a tension linkage having a distal end extending away from the base, the tension linkage supported by the guide arm when the guide arm is in the raised position; and a hook connected to the distal end of the tension linkage, wherein the guide arm does not support the tension linkage when the hook is engaged with the object and the guide arm is in the lowered position.

15. The apparatus of claim 14, further comprising a tension linkage guide located on the guide arm, the tension linkage extending through the tension linkage guide.

16. The apparatus of claim 15, wherein the tension linkage guide is movable along the tension linkage as the guide arm moves from the raised position to the lowered position.

17. The apparatus of claim 14, wherein:

the tension linkage forms a first tension angle with respect to a horizontal reference axis passing through the hook when the hook is engaged with object and the guide arm is in the raised position;

the tension linkage forms a second tension angle with respect to the horizontal reference axis when the hook is engaged with the object and the guide arm is in the lowered position; and the second tension angle is less than the first tension angle.

18. A method of moving an object, the method comprising the steps of:

(a) providing a removal apparatus including a base, a guide arm pivotable relative to the base, the guide arm movable between a raised position and a lowered position, a tension linkage having a distal end extending away from the base, the tension linkage supported by the guide arm when the guide arm is in the raised position, a tension linkage guide disposed on the guide arm, the tension linkage guide movable along the tension linkage, and a hook connected to the distal end of the tension linkage;

(b) lowering the removal apparatus with the guide arm in the raised position;

(c) engaging the hook with the object, the tension linkage forming a first tension angle with respect to a horizontal reference axis passing through the hook;

(d) moving the guide arm from the raised position to the lowered position; and (e) raising the removal apparatus, the tension linkage forming a second tension angle with respect to the horizontal reference axis when the guide arm is in the lowered position, the second tension angle being less than the first tension angle.

19. The method of claim 18, wherein the tension linkage is not supported by the guide arm in step (d) when the guide arm is in the lowered position.

20. The method of claim 18, wherein:

the tension linkage guide engages the tension linkage at a first engagement position when the guide arm is in the raised position;

the tension linkage guide engages the tension linkage at a second engagement position when the guide arm is in the lowered position; and the tension linkage guide during the moving step moves along the tension linkage from the first engagement position to the second engagement position as the guide arm moves from the raised position to the lowered position.

* * * * *